US012768089B2

(12) United States Patent
Park et al.

(10) Patent No.: US 12,768,089 B2
(45) Date of Patent: Oct. 20, 2026

(54) CLOTHES TREATING SYSTEM AND METHOD FOR CONTROLLING THEREOF

(71) Applicant: SAMSUNG ELECTRONICS CO., LTD., Suwon-si (KR)

(72) Inventors: Jaeryong Park, Suwon-si (KR); Byeongcheol Yoon, Suwon-si (KR); Younghak Kong, Suwon-si (KR); Seulgi Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 147 days.

(21) Appl. No.: 18/795,772

(22) Filed: Aug. 6, 2024

(65) Prior Publication Data

US 2025/0092592 A1 Mar. 20, 2025

Related U.S. Application Data

(63) Continuation of application No. PCT/KR2024/009869, filed on Jul. 10, 2024.

(30) Foreign Application Priority Data

Sep. 19, 2023 (KR) ..... 10-2023-0125123
Nov. 6, 2023 (KR) ..... 10-2023-0152183

(51) Int. Cl.
*D06F 29/00* (2006.01)
*D06F 33/32* (2020.01)
*D06F 34/26* (2020.01)

(52) U.S. Cl.
CPC ..... *D06F 29/005* (2013.01); *D06F 33/32* (2020.02); *D06F 34/26* (2020.02)

(58) Field of Classification Search
CPC ..... D06F 29/005
See application file for complete search history.

(56) References Cited

U.S. PATENT DOCUMENTS 7,383,644 B2 6/2008 Lyu et al.
9,163,347 B2 10/2015 Yang
(Continued)

FOREIGN PATENT DOCUMENTS

KR 10-2005-0066535 6/2005
KR 10-2005-0094287 9/2005
(Continued)

OTHER PUBLICATIONS

International Search Report dated Nov. 13, 2024 for International Application No. PCT/KR2024/009869.
(Continued)

*Primary Examiner* — Jason Y Ko
(74) *Attorney, Agent, or Firm* — STAAS & HALSEY LLP

(57) ABSTRACT

A clothes treating system may include a washing machine including a tub; a dryer including a heat pump and a fan; a first flow path; a damper to open and close the first flow path; a second flow path; a humidity sensor to detect humidity inside the tub; and a controller configured to: determine whether to perform a tub drying cycle, based on the detected humidity, and based on determining to perform the tub drying cycle, open the first flow path with the damper, operate the heat pump to heat air, and operate the fan to move the heated air through the first flow path, so that air flows into the tub through the first flow path and moisture from the tub is absorbed by the air and flows into the dryer through the second flow path.

15 Claims, 19 Drawing Sheets

(56) References Cited

U.S. PATENT DOCUMENTS

| | | | |
|---|---|---|---|
| 2007/0119072 | A1 | 5/2007 | Kim |
| 2015/0167222 | A1 | 6/2015 | Hwang et al. |

FOREIGN PATENT DOCUMENTS

| | | | |
|---|---|---|---|
| KR | 10-0652459 | | 12/2006 |
| KR | 10-0855001 | | 8/2008 |
| KR | 10-2011-0040081 | A | 4/2011 |
| KR | 10-2015-0070628 | A | 6/2015 |
| KR | 10-2022-0161114 | A | 12/2022 |
| KR | 10-2023-0109911 | | 7/2023 |
| KR | 10-2023-0123393 | A | 8/2023 |

OTHER PUBLICATIONS

Written Opinion dated Nov. 13, 2024 for International Application No. PCT/KR2024/009869.

CLOTHES TREATING SYSTEM AND METHOD FOR CONTROLLING THEREOF

CROSS-REFERENCE TO RELATED APPLICATIONS

This is a continuation application, under 35 U.S.C. § 111(a), of International Application PCT/KR2024/009869, filed Jul. 10, 2024, which claims priority under 35 U.S.C. § 119 to Korean Patent Application No. 10-2023-0125123, filed Sep. 19, 2023 and Korean Patent Application No. 10-2023-0152183, filed Nov. 6, 2023, in the Korean Intellectual Property Office, the disclosures of which are incorporated herein in their entireties by reference.

TECHNICAL FIELD

The present disclosure relates to a clothes treating system including a clothes treating apparatus and a control method thereof.

BACKGROUND ART

A clothes treating apparatus is used to treat and/or care clothes. For example, the clothes treating apparatus is a washing machine or a dryer.

The washing machine is an apparatus for washing laundry. The washing machine washes laundry accommodated in the drum by rotating the drum to stir the laundry and water supplied into the tub together with a detergent. The washing machine washes laundry through three cycles. For example, the washing machine performs a washing cycle of supplying water and a detergent into the tub and washing laundry while rotating the drum, a rinsing cycle of supplying water into the tub and rotating the drum to rinse the laundry, and a dehydrating cycle of discharging water from the tub and rotating the drum to remove moisture from the laundry.

The dryer is used to dry objects accommodated in the drum. The dryer dries the objects by supplying hot air into the drum while rotating the drum at relatively low speed. The dryer dries objects by performing a drying cycle.

A clothes treating system may include a plurality of clothes treating apparatuses. For example, the clothes treating system includes a washing machine and a dryer. The washing machine may be electrically connected to the dryer and interact with the dryer.

DISCLOSURE

Technical Solution

The disclosure may provide a clothes treating system including a duct structure for effectively removing water vapor and/or moisture remaining inside a tub and drum of a washing machine.

The disclosure may provide a clothes treating system capable of suppressing the growth of mold and bacteria in a tub and drum of a washing machine and keeping the tub and drum of the washing machine clean by performing a tub drying process, and a method of controlling the clothes treating system.

The disclosure may provide a clothes treating system capable of suppressing the growth of mold and bacteria in an indoor space by preventing a large amount of water vapor in a tub from being discharged into the indoor space immediately after a washing machine completes an operation related to laundry washing, and a method of controlling the clothes treating system.

A clothes treating system according to an embodiment may include: a washing machine including a tub; a dryer including a heat pump and a fan; a first duct to form a first flow path to move air heated by the heat pump to the tub; a damper configured to open and close the first flow path; a second duct to form a second flow path to move moisture from the tub to the dryer; a humidity sensor to detect humidity inside the tub; and a controller configured to: determine whether to perform a tub drying cycle to remove the moisture from the tub, based on the detected humidity, and based on determining to perform the tub drying cycle, open the first flow path with the damper, operate the heat pump to heat air, and operate the fan to move the heated air through the first flow path, so that the heated air flows into the tub through the first flow path and the moisture from inside the tub is absorbed by the heated air and flows with the heated air into the dryer through the second flow path.

The first duct may include: a first duct first end penetrating a lower rear side of a housing of the dryer; and a first duct second end connected to an upper front side of the tub, and the second duct may include: a second duct first end connected to a lower side of the tub; and a second duct second end penetrating a rear upper side of the housing.

The damper may be a first damper, the dryer may further include: a drum of the dryer, a guide duct to guide the air heated by the heat pump to the drum of the dryer, and a second damper configured to open and close the guide duct, and the controller may be further configured to: based on determining to perform the tub drying cycle, close the second damper to prevent the heated air from being supplied to the drum of the dryer through the guide duct.

The dryer may further include a drum of the dryer, the first duct may include: a first duct first end penetrating a lower rear side of a housing of the dryer, and a first duct second end connected to an upper front side of the tub, and the second duct may include: a second duct first end connected to a lower rear side of the tub, and a second duct second end connected to a filter duct which is positioned in front of the drum of the dryer.

The damper may be a first damper, the dryer may further include: a guide duct to guide the air heated by the heat pump to the drum of the dryer; a second damper configured to open and close the guide duct; and a third damper configured to open and close the filter duct, and the controller may be further configured to: based on determining to perform the tub drying cycle, close the second damper to prevent the heated air from being supplied to the drum of the dryer through the guide duct and close the third damper to prevent the moisture absorbed by the heated air from flowing through the filter duct into the drum of the dryer.

The washing machine may further include: a first drum, and a first drum motor configured to rotate the first drum, the dryer may further include: a second drum, and a second drum motor configured to rotate the second drum, and the controller may be further configured to: in the tub drying cycle, control the first drum motor to rotate the first drum of the washing machine and control the second drum motor to stop rotation of the second drum of the dryer.

The washing machine may further include a drum of the washing machine, and the controller may be further configured to determine whether to perform the tub drying cycle after an operation of the washing machine related to washing of laundry accommodated in the drum of the washing machine is completed.

The controller may be further configured to control the humidity sensor to detect humidity inside the tub while a door of the washing machine is closed.

The controller may be further configured to stop operation of the heat pump and operation of the fan based on the detected humidity becoming lower than a preset reference humidity while the tub drying cycle is performed.

The clothes treating system may further include: a user interface configured to obtain a user input, wherein the controller is further configured to determine whether to perform the tub drying cycle based on a selection of a tub drying course according to the user input and the detected humidity.

The washing machine may further include: a door, and a door driving device configured to open and close the door, and the controller may be further configured to control the door driving device to open the door based on completion of the tub drying cycle.

A method of controlling a clothes treating system having a washing machine including a tub, a dryer including a heat pump, and a fan, a first duct to form a first flow path to move air heated by the heat pump to the tub, a damper configured to open and close the first flow path, a second duct to form a second flow path to move moisture from the tub to the dryer, a humidity sensor to detect humidity inside the tub, and a controller, the method may include: detecting humidity inside the tub with the humidity sensor; determining, by the controller, whether to perform a tub drying cycle to remove the moisture from the tub based on the detected humidity; and by the controller, based on determining to perform the tub drying cycle, opening the first flow path with the damper, operating the heat pump to heat air, and operating the fan to move the heated air through the first flow path, so that the heated air flows into the tub through the first flow path and the moisture from inside the tub is absorbed by the heated air and flows with the heated air into the dryer through the second flow path.

The damper may be a first damper, and the dryer may further include: a drum of the dryer, a guide duct to guide the air heated by the heat pump to the drum of the dryer, and a second damper configured to open and close the guide duct, and the method may further include: by the controller, based on determining to perform the tub drying cycle, closing the second damper to prevent the heated air from being supplied to the drum of the dryer through the guide duct.

The damper may be a first damper, and the dryer may further include: a drum of the dryer, a guide duct to guide the air heated by the heat pump to the drum of the dryer, a second damper configured to open and close the guide duct, a filter duct positioned in front of the drum of the dryer, and a third damper configured to open and close the filter duct, and the method may further include by the controller, based on determining to perform the tub drying cycle, closing the second damper to prevent the heated air from being supplied to the drum of the dryer through the guide duct and closing the third damper to prevent the moisture absorbed by the heated air from flowing through the filter duct into the drum of the dryer.

The washing machine may further include: a first drum, and a first drum motor configured to rotate the first drum, the dryer may further include: a second drum, and a second drum motor configured to rotate the second drum, and the method may further include: by the controller, in the tub drying cycle, controlling the first drum motor to rotate the first drum of the washing machine and controlling the second drum motor to stop rotation of the second drum of the dryer.

The clothes treating system may provide a duct structure for effectively removing water vapor and/or moisture remaining inside the tub and drum of the washing machine.

The clothes treating system and the control method thereof may suppress the growth of mold and bacteria in the tub and drum of the washing machine and keeping the tub and drum of the washing machine clean by performing a tub drying process.

The clothes treating system and the control method thereof may suppress the growth of mold and bacteria in an indoor space by preventing a large amount of water vapor in the tub from being discharged into the indoor space immediately after the washing machine completes an operation related to laundry washing.

MODES OF THE INVENTION

Figure 1:
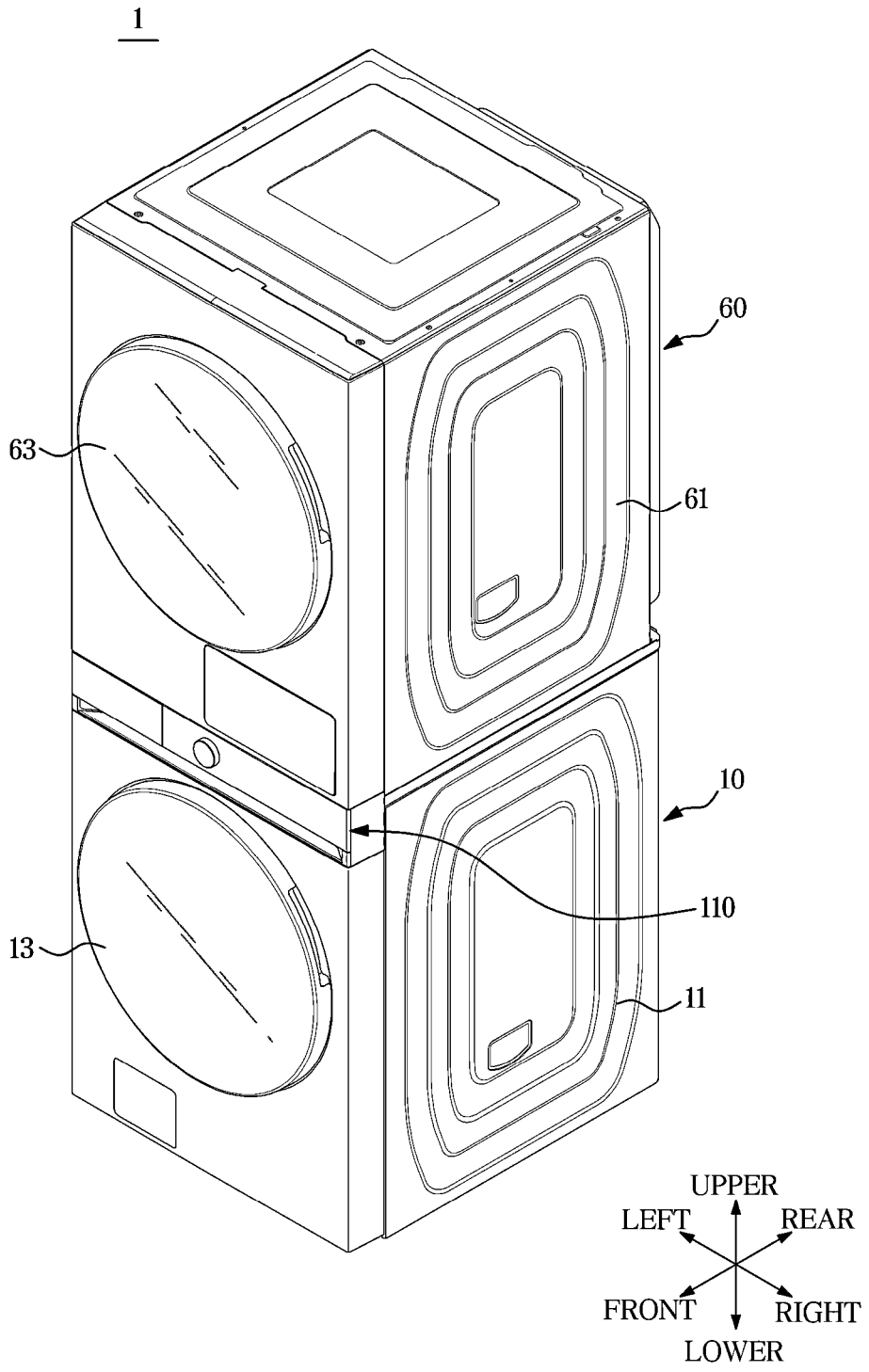
FIG. 1 shows a clothes treating system according to an embodiment.

It should be appreciated that various embodiments of the disclosure and the terms used therein are not intended to limit the technological features set forth herein to particular embodiments and include various changes, equivalents, or replacements for a corresponding embodiment.

With regard to the description of the drawings, similar reference numerals may be used to refer to similar or related elements.

Singular forms of nouns corresponding to items may include one or more of the items, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases.

The term "and/or" includes any and all combinations of one or more of a plurality of associated listed components.

As used herein, such terms as "1st" and "2nd" or "first" and "second" may be used to simply distinguish a corresponding component from another, and does not limit the components in another aspect (for example, importance or order).

It is to be understood that if a certain component (for example, a first component) is referred to, with or without the term "operatively" or "communicatively", as "coupled with," "coupled to," "connected with," or "connected to" another component (for example, a second component), it means that the component may be coupled with the other component directly (for example, by wire), wirelessly, or via a third element.

It is to be understood that the terms such as "including" or "having," etc., are intended to indicate the existence of the features, numbers, steps, operations, components, parts, or combinations thereof disclosed in the specification, and are not intended to preclude the possibility that one or more other features, numbers, steps, operations, components, parts, or combinations thereof may exist or may be added.

It will be understood that when a certain component is referred to as being "connected to", "coupled to", "supported by" or "in contact with" another component, it can be directly or indirectly connected to, coupled to, supported by, or in contact with the other component. When a component is indirectly connected to, coupled to, supported by, or in contact with another component, it may be connected to, coupled to, supported by, or in contact with the other component through a third component.

It will also be understood that when a certain component is referred to as being "on" or "over" another component, it can be directly on the other component or intervening components may also be present.

A washing machine according to various embodiments may perform a washing cycle, a rinsing cycle, a dehydrating cycle, and/or a drying cycle. The washing machine may be an example of a clothes treating apparatus, and the clothes treating apparatus may be a concept including an apparatus for washing clothes (an object to be washed or an object to be dried), an apparatus for drying clothes, and an apparatus capable of performing both washing and drying.

The washing machine according to various embodiments of the disclosure may include a top-loading washing machine, wherein an inlet through which laundry is put into or taken out of the top-loading washing machine opens upward, or a front-loading washing machine, wherein a laundry inlet opens in a front direction, although kinds of the washing machine are not limited thereto.

The top-loading washing machine may wash laundry with water streams generated by a rotating body such as a pulsator. The front-loading washing machine may wash laundry by rotating a drum to repeatedly raise and drop the laundry. The front-loading washing machine may include a washing machine with a drying function, which is capable of drying laundry accommodated in a drum. The washing machine with the drying function may include a hot air supply for supplying hot air into the drum and a condenser for removing moisture of air discharged from the drum. For example, the washing machine with the drying function may include a heat pump. The washing machine according to various embodiments may include a washing machine using another washing method other than the above-described washing methods.

Hereinafter, a clothes treating system according to various embodiments will be described in detail.

Hereinafter, a clothes treating system according to various embodiments of the disclosure will be described in detail with reference to the accompanying drawings.

FIG. 1 shows a clothes treating system according to an embodiment.

Referring to FIG. 1, the clothes treating system 1 may include a washing machine 10 and a dryer 60. The dryer 60 may be positioned to one side of the washing machine 10. For example, the dryer 60 may be mounted on the washing machine 10. The washing machine 10 is also referred to as a first clothes treating apparatus. The dryer 60 is also referred to as a second clothes treating apparatus.

The washing machine 10 may include a first housing 11 in which various components are accommodated. The first housing 11 may have various shapes. For example, the first housing 11 may have a rectangular parallelepiped shape. A first door 13 may be provided on a front side of the first housing 11.

The dryer 60 may include a second housing 61 in which various components are accommodated. The second housing 61 may have various shapes. For example, the second housing 61 may have a rectangular parallelepiped shape. A second door 63 may be provided on a front side of the second housing 61.

The clothes treating system 1 may include a user interface 110. The user interface 110 may be provided in at least one of the washing machine 10 and the dryer 60. For example, the user interface 110 may be provided between the washing machine 10 and the dryer 60 arranged vertically.

The user interface 110 may obtain a user input. The user interface 110 may include various buttons and/or a rotatable dial. For example, the user interface 110 may include a power button for powering on/off each of the washing machine 10 and the dryer 60, a pause button for starting or pausing a washing operation and/or a drying operation, and a setting button for enabling a user to select each of a washing course, a detailed setting for washing, a drying course, and a detailed setting for drying. By rotating the dial, one of a plurality of washing courses or one of a plurality of drying courses may be selected.

The user interface 110 may display various information related to operations of the clothes treating system 1. For example, the user interface 110 may display operation information of the washing machine 10 and operation information of the dryer 60. The user interface 110 may display a washing course, a detailed setting for washing, a washing time, a drying course, a detailed setting for drying, and/or a drying time.

The user interface 110 may include a display. The display may be provided as a Liquid Crystal Display (LCD) panel and/or a Light Emitting Diode (LED) panel. The user interface 110 may include a touch display. The above-described various buttons may be provided through the touch display. The user interface 110 may display a Graphic User Interface (GUI).

The user interface 110 may be provided as a single interface capable of controlling the washing machine 10 and the dryer 60 in an integrated manner, although not limited thereto. However, a user interface for controlling the washing machine 10 and a user interface for controlling the dryer 60 may be provided separately.

The washing machine 10 may provide various washing courses depending on the design. The washing courses may include various washing settings depending on kinds (for example, blanket, underwear, etc.) and materials (for example, cotton, wool, etc.) of laundry. For example, the washing machine 10 may provide various washing courses, such as a standard course, a strong course, a delicate course, a bedding course, a baby clothes course, a towel course, a small amount course, a boiling course, a power saving course, an outdoor clothes course, a rinsing and dehydrating course, a rinsing course, and a dehydrating course.

The dryer 60 may provide various drying courses depending on the design. The drying courses may include various drying settings depending on kinds and materials of objects. For example, the dryer 60 may provide various drying cycles, such as standard drying, strong drying, delicate clothes drying, bedding drying, baby clothes drying, towel drying, small amount drying, power saving drying, and outdoor clothes drying.

Also, the clothes treating system 1 may provide a tub drying course for removing moisture inside the tub 20 and the first drum 30 of the washing machine 10.

While the washing machine 10 operates according to the above-described washing courses, internal humidity of the tub 20 may increase greatly due to water supplied into the tub 20 and wet laundry existing in the first drum 30. The high internal humidity of the tub 20 may be maintained until the first door 13 opens after the operation of the washing machine 10 is completed. Also, even after the laundry is taken out of the first drum 30, moisture may remain inside the tub 20 and the first drum 30. After the laundry is taken out and the first door 13 of the washing machine 10 is closed, moisture remaining inside the tub 20 will not be discharged to outside.

Moisture remaining inside the tub 20 may grow mold and bacteria inside the tub 20. Discharging a large amount of moisture accommodated inside the tub 20 to an indoor space (that is, a space where the washing machine 10 is positioned) immediately after an operation of the washing machine 10 is completed may grow mold and bacteria in the indoor space due to the discharged moisture. According to the growth of mold and bacteria, bad odors may be generated in the tub 20 and the indoor space, which may result in a negative effect on a user's hygiene. Accordingly, the clothes treating system 1 according to the disclosure may provide a tub drying course for removing moisture inside the tub 20 and the first drum 30.

Figure 2:
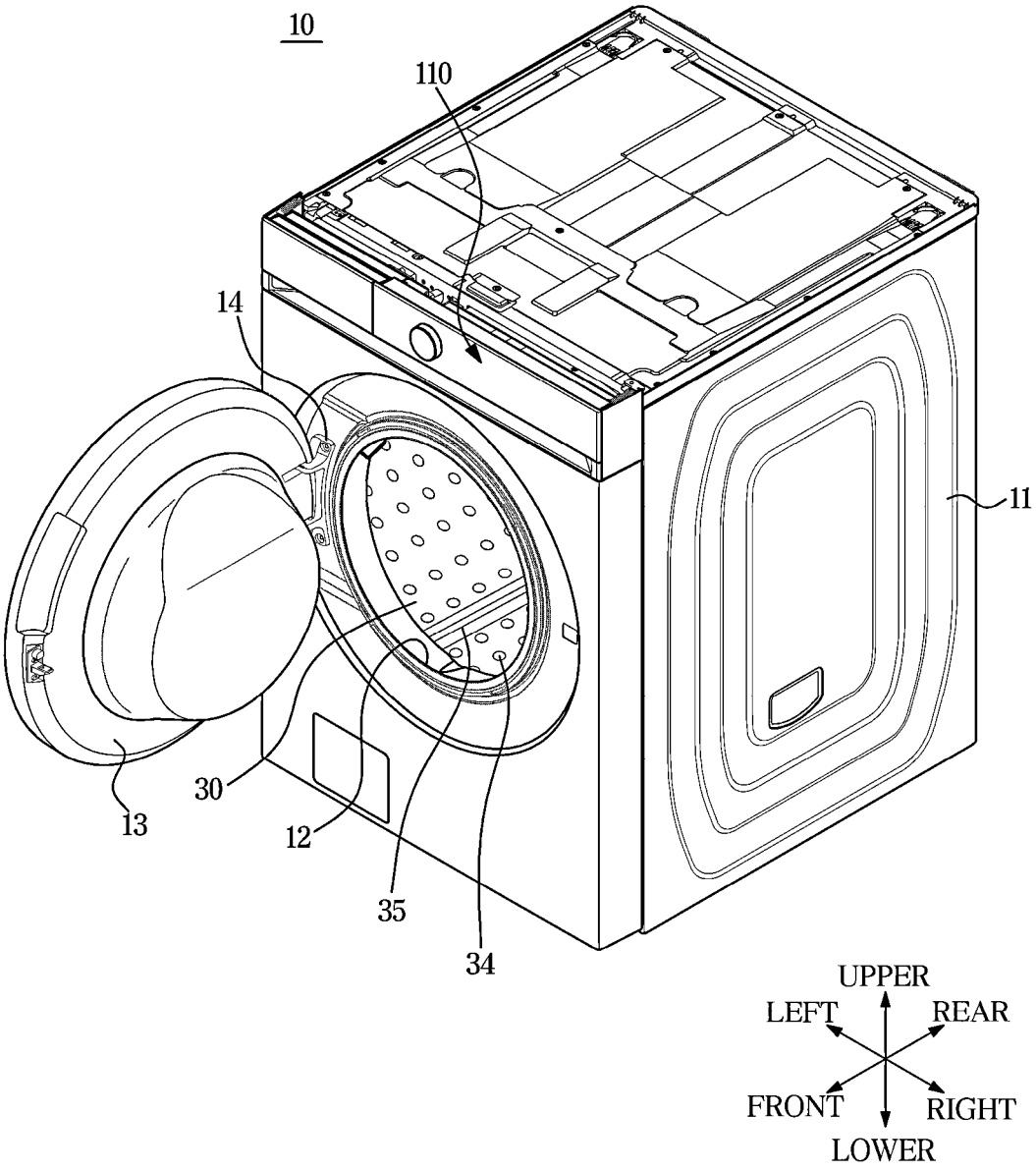
FIG. 2 shows a washing machine included in a clothes treating system according to an embodiment.

FIG. 2 shows a washing machine included in a clothes treating system according to an embodiment.

Referring to FIG. 2, a laundry inlet 12 may be formed in the front side of the first housing 11. The first door 13 may open or close the laundry inlet 12. The first door 13 may be rotatably installed on the first housing 11 by a first hinge 14. At least one portion of the first door 13 may be transparent or translucent to show inside of the first housing 11.

The user interface 110 may be provided at a front, upper portion of the first housing 11. The user interface 110 is shown to be included in the washing machine 10, although not limited thereto. The user interface 110 may be included in the dryer 60. The user interface 110 may be provided as a device that is independent from the washing machine 10 and the dryer 60.

The tub 20 and the first drum 30 may be provided inside the first housing 11. The first drum 30 may be rotatably positioned inside the tub 20. Water may be accommodated in the tub 20. Laundry may be accommodated inside the drum 30. Each of the tub 20 and the first drum 30 may have a cylindrical shape with an opening.

The first drum 30 may include a plurality of through holes 34. Water stored in the tub 20 may flow into the first drum 30 through the plurality of through holes 34 or may be discharged out of the first drum 30 through the plurality of through holes 34. On an inner surface of the first drum 30, at least one first lifter 35 may be installed. While the drum 30 rotates, laundry may rise or fall by the first lifter 35.

Figure 3:
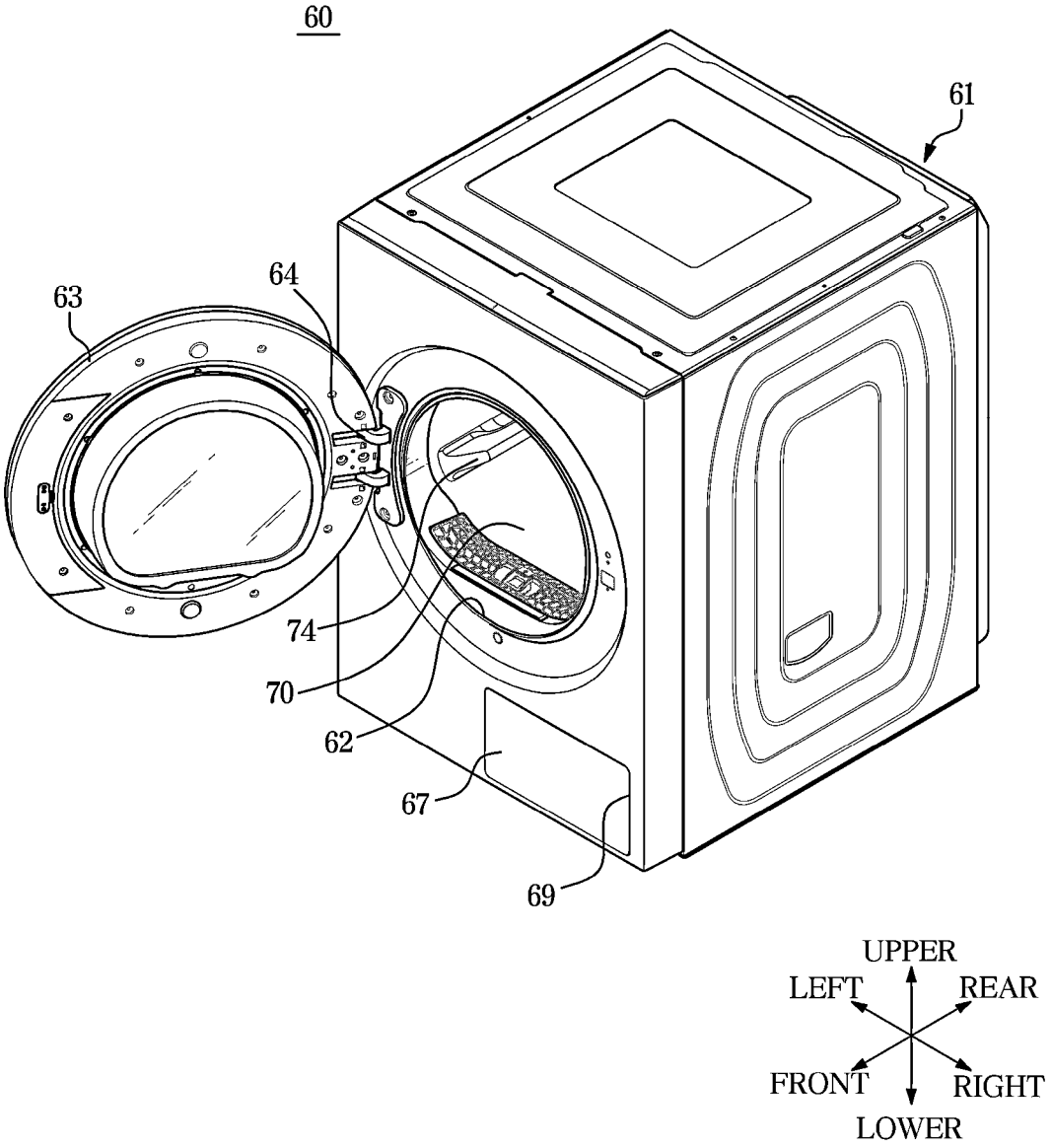
FIG. 3 shows a dryer included in a clothes treating system according to an embodiment.

FIG. 3 shows a dryer included in a clothes treating system according to an embodiment.

Referring to FIG. 3, an object inlet 62 may be formed in a front side of the second housing 61. The second door 63 may open or close the object inlet 62. The second door 63 may be rotatably installed on the second housing 61 by a second hinge 64. At least one portion of the second door 63 may be transparent or translucent to show inside of the second housing 61.

Inside the second housing 61, a second drum 70 may be provided to accommodate an object. The second drum 70 may be rotatably positioned inside the second housing 61. The second drum 70 may have a cylindrical shape with an opening. An object may sequentially pass through the object inlet 62 and a second drum opening 72 to be accommodated in the second drum 70 or withdrawn from the second drum 70. At least one lifter 74 may be provided inside the second drum 70.

A housing opening 69 may be formed at a portion of a front side of the second housing 61. The housing opening 69 may be opened or closed by a housing cover 67. A front surface of the housing cover 67 and a front surface of the second housing 61 may form a flat surface without any steps.

Figure 4:
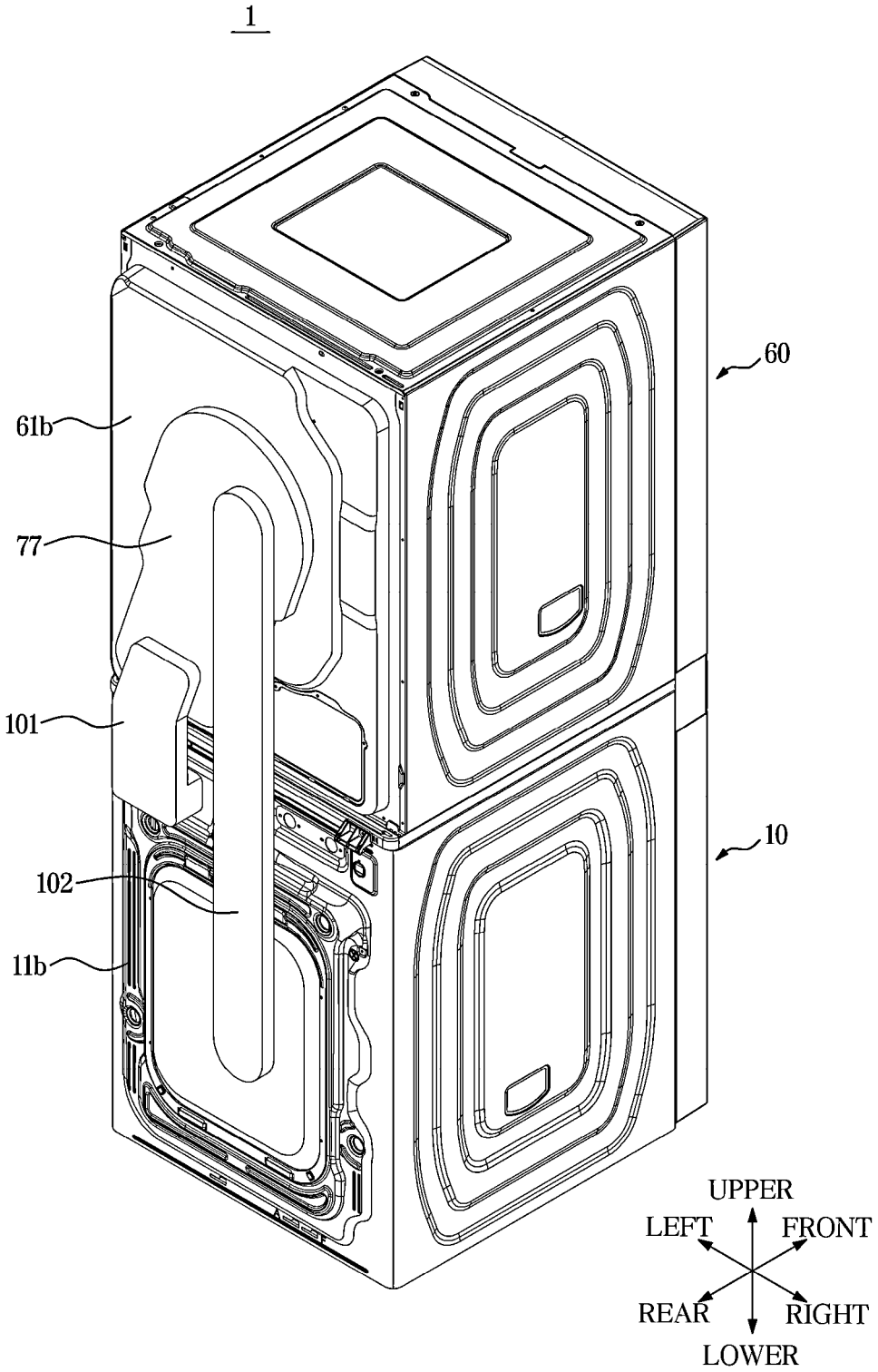
FIG. 4 shows a rear side of a clothes treating system according to an embodiment.

FIG. 4 shows a rear side of a clothes treating system according to an embodiment.

Referring to FIG. 4, the clothes treating system 1 may include a first duct 101 forming a first flow path for moving hot air generated by a heat pump 80 of the dryer 60 to the tub 20 of the washing machine 10, and a second duct 102 forming a second flow path for moving inside air of the tub 20 of the washing machine 10 to the dryer 60. The first duct 101 may also be referred to as a 'hot air supply duct'. The second duct 102 may also be referred to as a 'moisture discharge duct'.

The first duct 101 may include one end penetrating a lower portion of a rear side 61*b* of the second housing 61 of the dryer 60 and another end connected to an upper, front portion of the tub 20 of the washing machine 10. The one end of the first duct 101 may be connected to a heating duct 76 provided inside the second housing 61 (see FIGS. 5 and 6). The other end of the first duct 101 may penetrate a rear side 11*b* of the first housing 11.

The second duct 102 may include one end connected to a lower, rear portion of the tub 20 of the washing machine 10 and another end penetrating an upper portion of the rear side 61*b* of the second housing 61 of the dryer 60. The one end of the second duct 102 may penetrate the rear side 11*b* of the first housing 11. The one end of the second duct 102 may be connected to the lower, rear portion of the tub 20. The other end of the second duct 102 may penetrate the rear side 61*b* of the second housing 61 and be adjacent to a rear side of the second drum 70 (see FIG. 5).

Figure 6:
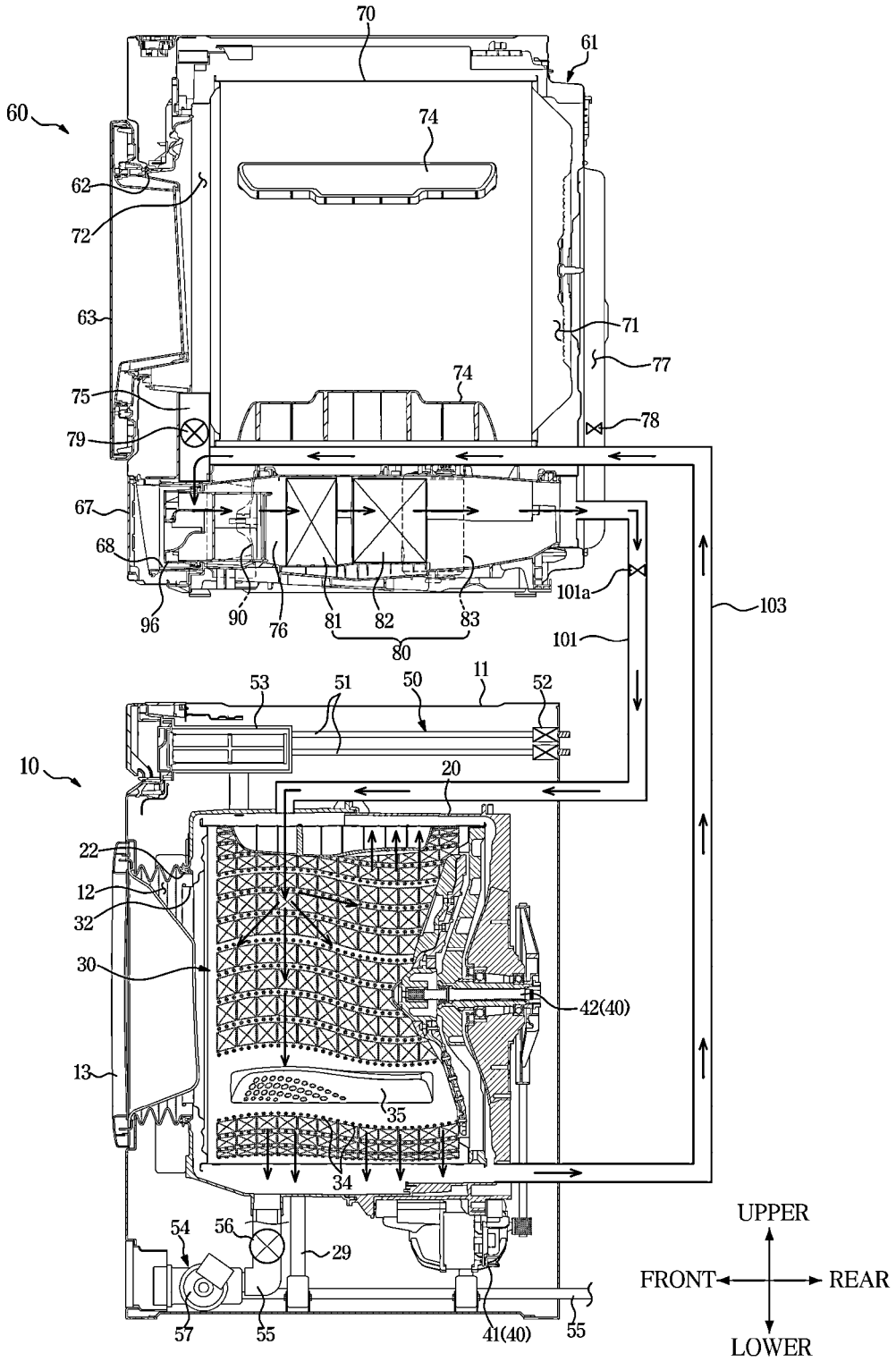
FIG. 6 shows a cross-section of a clothes treating system according to another embodiment.

The second duct 102 may be replaced with a third duct 103 shown in FIG. 6. In FIG. 6, one end of the third duct 103 may penetrate the rear side 11*b* of the first housing 11 and be connected to the lower, rear portion of the tub 20. Another end of the third duct 103 may penetrate the rear side 61*b* of the second housing 61 and be connected to a filter duct 75 positioned in front of the drum 30.

Referring again to FIG. 4, the first duct 101 and the second duct 102 may protrude from the rear side 11*b* of the first housing 11 of the washing machine 10 and the rear side 61*b* of the second housing 61 of the dryer 60. To prevent the esthetic sense of the clothes treating system 1 from being reduced due to the first duct 101 and the second duct 102 protruding out of the first housing 11 and the second housing 61, a separate housing for covering the first duct 101 and the second duct 102 may be provided.

The first duct 101 and the second duct 102 may not protrude out of the first housing 11 and the second housing 61, which is not shown in FIG. 4. That is, the first duct 101 and the second duct 102 may be positioned inside the first housing 11 and the second housing 61. In other words, the first housing 11 and the second housing 61 may form an outer appearance of the clothes treating system 1, and the first duct 101 and the second duct 102 may not be exposed outside the first housing 11 and the second housing 61. In this case, a separate housing for covering the first duct 101 and the second duct 102 may not be needed.

The dryer 60 may include a guide duct 77 that guides hot air generated by the heat pump 80 into the second drum 70. The guide duct 77 may be integrated into the second housing 61 or coupled to the rear side of the second housing 61. The guide duct 77 may form a portion of the rear side 61*b* of the second housing 61. The first duct 101 may penetrate a lower portion of the guide duct 77. The second duct 102 may penetrate an upper portion of the guide duct 77.

An internal structure of the clothes treating system 1, the first duct 101, and the second duct 102 will be described in detail with reference to FIGS. 5 and 6.

Figure 5:
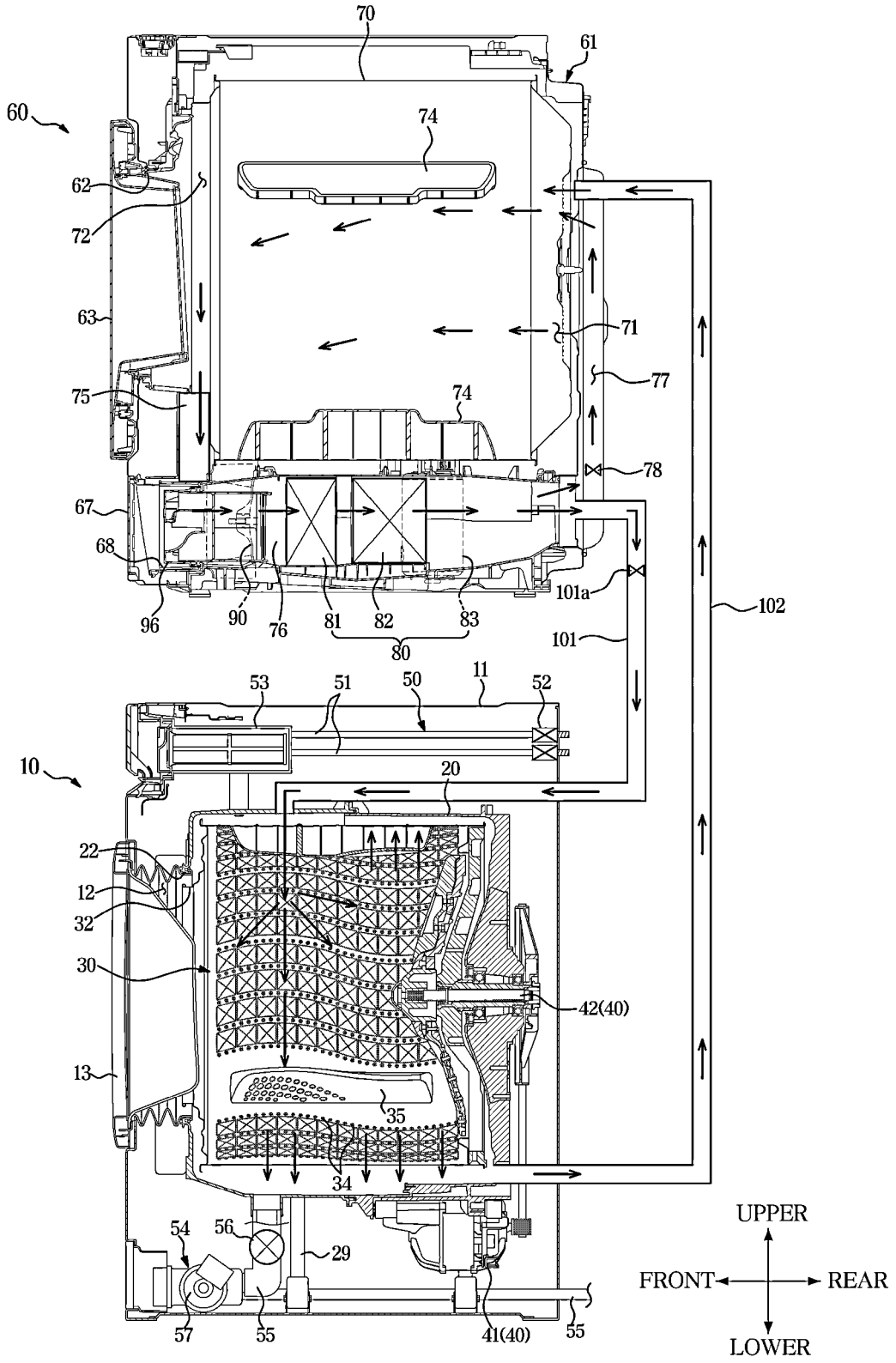
FIG. 5 shows a cross-section of a clothes treating system according to an embodiment.

FIG. 5 shows a cross-section of a clothes treating system according to an embodiment.

Referring to FIG. 5, the tub 20 of the washing machine 10 may include a tub opening 22 at one side. The tub 20 may be positioned inside the first housing 11 such that the tub opening 22 corresponds to the laundry inlet 12. The tub 20 may be connected to the first housing 11 by a damper 29. The damper 29 may attenuate vibration transferred to the first housing 11 by absorbing vibration generated while the first drum 30 rotates.

A first drum opening 32 of the first drum 30 of the washing machine 10 may correspond to the laundry inlet 12 and the tub opening 22. Laundry may sequentially pass through the laundry inlet 12, the tub opening 22, and the first drum opening 32 to be accommodated inside the first drum 30 or taken out of the first drum 30.

The first drum 30 may perform operations according to washing, rinsing, and/or dehydrating cycles while rotating inside the tub 20. Water stored in the tub 20 may flow into the inside of the first drum 30 through the plurality of through holes 34 formed in the first drum 30 or may be discharged out of the first drum 30 through the plurality of through holes 34. The at least one lifter 35 may be installed on the inner surface of the first drum 30.

The washing machine 10 may include a first driver 40 for rotating the first drum 30. The first driver 40 may include a first drum motor 41, and a first rotating shaft 42 for transferring a driving force generated in the first drum motor 41 to the first drum 30. The first rotating shaft 42 may be connected to the first drum 30 by penetrating the tub 20. The first driver 40 may rotate the first drum 30 in a clockwise direction or a counterclockwise direction.

The washing machine 10 may include a water supply 50 for supplying water to the tub 20. The water supply 50 may include a water supply tube 51, and a water supply valve 52 provided in the water supply tube 51. The water supply tube 51 may be connected to an external water supply source. The water supply tube 51 may extend to a detergent supply device 53 and/or the tub 20 from the external water supply source. Water may be supplied to the tub 20 via the detergent supply device 53. Water may be supplied to the tub 20 not via the detergent supply device 53.

The water supply valve 52 may open or close the water supply tube 51 under a control by a first controller 200. The water supply valve 52 may allow or block supply of water from the external water supply source to the tub 20. The water supply valve 52 may include, for example, a solenoid valve that is opened or closed in response to an electrical signal.

The washing machine 10 may include the detergent supply device 53 configured to supply a detergent to the tub 20. The detergent supply device 53 may include a manual detergent supply device into which a user needs to put a detergent to be used whenever performing washing, and/or an automatic detergent supply device which stores a large amount of detergent and automatically puts a preset amount of detergent upon washing. The detergent supply device 53 may include a detergent case for storing a detergent.

The detergent supply device 53 may supply a detergent into the inside of the tub 20 while water is supplied. Water supplied through the water supply tube 51 may be mixed with a detergent via the detergent supply device 53. The water mixed with the detergent may be supplied to the inside of the tub 20. The detergent may include a detergent for pre-washing, a detergent for main washing, a fabric softener, bleach, etc., and the detergent case may be partitioned into a pre-washing detergent storage area, a main washing detergent storage area, a fabric softener storage area, and a bleach storage area.

The washing machine 10 may include a drain device 54 for discharging water accommodated in the tub 20 to outside. The drain device 54 may include a drain tube 55 extending from a lower portion of the tub 20 to outside of the first housing 11, a drain valve 56 provided at the drain tube 55 and configured to open or close the drain tube 55, and a pump 57 provided on the drain tube 55. The pump 57 may pump water of the drain tube 55 to the outside of the first housing 11.

According to various embodiments, the washing machine 10 may further include a heater for heating water stored in the tub 20. According to various embodiments, the washing machine 10 may further include a heater for heating water supplied through the water supply 50.

The dryer 60 may include a second drum 70 that accommodates an object. The second drum 70 may be positioned inside the second housing 61 such that a second drum opening 72 provided at one side of the second drum 70 corresponds to the object inlet 62. An object may pass through the object inlet 62 and the second drum opening 72 sequentially to be accommodated inside the second drum 70 or taken out of the second drum 70.

The second drum 70 may be rotatably provided inside the second housing 61. The second drum 70 may be connected to a second drum motor 73 and rotate according to driving of the second drum motor 73. The second drum motor 73 may rotate the second drum 70 in the clockwise direction or the counterclockwise direction.

The at least one second lifter 74 may be provided inside the second drum 70. While the second drum 70 rotates, an object to be dried, accommodated in the second drum 70 may repeatedly rise and fall by the second lifter 74.

The heating duct 76 may be provided below the second drum 70. The heat pump 80 may be positioned inside the heating duct 76. The heat pump 80 may include an evaporator 81, a condenser 82, a compressor 83, and an expander 84. The heat pump 80 may generate hot air. The heating duct 76 may form a flow path of hot air. Also, the heat pump 80 may remove moisture included in air passing through the heat pump 80. An operation of the heat pump 80 will be described in detail with reference to FIG. 7, below.

A fan 90 may be positioned below the second drum 70. The fan 90 may be positioned inside the heating duct 76 or connected to the heating duct 76. The fan 90 may circulate inside air of the second housing 61. The fan 90 may form a circulating airflow passing through the second drum 70 inside the second housing 61. Air heated by the heat pump 80 may flow by an operation of the fan 90. Also, the fan 90 may intake inside air of the second drum 70 and send the air to the heat pump 80.

According to various embodiments, a fan motor for rotating the fan 90 may be provided separately from the second drum motor 73 for rotating the second drum 70. Also, the second drum motor 73 may be connected to the second drum 70 and the fan 90 through different rotating shafts, and rotate both the second drum 70 and the fan 90. A rotation speed of the second drum 70 and a rotation speed of the fan 90 may be adjusted independently.

The second drum 70 may include an inlet 71 through which air enters inside of the second drum 70. Inside air of the second drum 70 may be discharged to the outside of the second drum 70 through the second drum opening 72. The inlet 71 may be positioned at another side of the second drum 70, the other side being opposite to the one side at which the second drum opening 72 is positioned. For example, the inlet 71 may be positioned in a rear portion of the second drum 70, and the second drum opening 72 may be positioned in a front portion of the second drum 70.

In a rear portion of the second housing 61, a guide duct 77 guiding hot air generated by the heat pump 80 to the inside of the second drum 70 may be provided. The guide duct 77 may be integrated into the second housing 61 or coupled to the rear portion of the second housing 61. The guide duct 77 may be connected to the heating duct 76.

While the dryer 60 performs a drying cycle, air heated by the heat pump 80 may sequentially pass through the heating duct 76 and the guide duct 77 and enter the inside of the second drum 70 through the inlet 71 formed in the rear portion of the second drum 70.

The filter duct 75 may be provided in front of the second drum 70. Air discharged from the second drum 70 through the second drum opening 72 may pass through the filter duct 75. The air passed through the filter duct 75 may enter a filter device 96. Lint included in the air may be filtered by the filter device 96. The air passed through the filter duct 75 and the filter device 96 may again flow into the heating duct 76.

The filter device 96 may be installed inside the second housing 61 through the housing opening 69. The filter device 96 may be detachably installed in a filter accommodating portion 68 formed inside the second housing 61. Lint generated during a process of drying an object may be stored in the filter device 96.

The first duct 101 may form the first flow path for moving hot air generated by the heat pump 80 of the dryer 60 to the tub 20 of the washing machine 10. One end of the first duct 101 may penetrate a lower portion of the rear side 61*b* of the second housing 61 of the dryer 60. In the case in which the guide duct 77 is integrated into the second housing 61, one end of the first duct 101 may penetrate a lower portion of the guide duct 77. The one end of the first duct 101 may be connected to the heating duct 76 provided inside the second housing 61.

Another end of the first duct 101 may be connected to the upper, front portion of the tub 20 of the washing machine 10. In the upper, front portion of the tub 20, a through hole connected to the first duct 101 may be provided. Hot air passed through the first duct 101 may flow into the tub 20 through the upper, front portion of the tub 20. The hot air flowed into the tub 20 may enter the inside of the first drum 30 through the plurality of through holes 34 of the first drum 30. The hot air flowed into the tub 20 and the first drum 30 may dry the tub 20 and the first drum 30.

One end of the second duct 102 may be connected to the lower, rear portion of the tub 20. In the lower, rear portion of the tub 20, an exhaust port connected to the second duct 102 may be provided. Another end of the second duct 102 may penetrate the upper portion of the rear side 61*b* of the dryer 60. In the case in which the guide duct 77 is integrated into the second housing 61, the other end of the second duct 102 may penetrate the upper portion of the guide duct 77. The other end of the second duct 102 may be adjacent to the rear side of the second drum 70.

Moisture inside the tub 20 and the first drum 30 may be discharged to a lower, rear portion of the tub 20 and move to the second drum 70 of the dryer 60 through the second duct 102. The moisture may flow along the second duct 102, and enter the inside of the second drum 70 through the inlet 71 of the second drum 70. Air containing the moisture may pass through the filter duct 75 and flow into the heating duct 76. The moisture may be removed by condensing in the evaporator 81 and thus, dry air may be heated in the condenser 82.

The other end of the first duct 101 connected to the upper, front portion of the tub 20 may be located diagonally to the one end of the second duct 102 connected to the lower, rear portion of the tub 20. That is, the through hole through which hot air flows into the tub 20 may be located diagonally to the exhaust port through which moisture is discharged from the tub 20.

As such, by supplying hot air to the upper, front portion of the tub 20 and discharging air inside the tub 20 from the lower, rear portion of the tub 20, an effect of drying the tub 20 and the first drum 30 by hot air may be improved. That is, because hot air reaches from the upper portion of the tub 20 to the lower portion of the tub 20, the entire of the tub 20 and the first drum 30 may be dried.

Inside the first duct 101, a first damper 101*a* for opening or closing the first duct 101 may be provided. Inside the guide duct 77, a second damper 78 for opening or closing the guide duct 77 may be provided. Operations of the first damper 101*a* and the second damper 78 may be controlled by a first controller 200 of the washing machine 10 or a second controller 400 of the dryer 60, which will be described below.

The dryer 60 may perform a drying cycle for drying clothes accommodated in the second drum 70. According to a selection of the drying course through the user interface 110, the dryer 60 may perform a drying cycle corresponding to the selected drying course.

While the dryer 60 performs the drying cycle, the first damper 101*a* may be controlled to close the first duct 101, and the second damper 78 may be controlled to open the guide duct 77. That is, in a drying cycle of the dryer 60, the first damper 101*a* may be closed, and the second damper 78 may be opened. In this case, hot air generated by the heat pump 80 may be supplied to the second drum 70 of the dryer 60 through the guide duct 77 without being supplied to the tub 20 of the washing machine 10. Air may circulate inside the second housing 61 of the dryer 60.

The washing machine 10 may perform a tub drying cycle for drying the tub 20 and the first drum 30. According to humidity inside the tub 20 being higher than or equal to preset reference humidity, the washing machine 10 may automatically perform a tub drying cycle. Also, according to a selection of the tub drying course through the user interface 110, the washing machine 10 may perform a tub drying cycle based on humidity inside the tub 20.

While the washing machine 10 performs a tub drying cycle, the first damper 101*a* may be controlled to open the first duct 101, and the second damper 78 may be controlled to close the guide duct 77. That is, in a tub drying cycle of the washing machine 10, the first damper 101*a* may be opened, and the second damper 78 may be closed. In this case, hot air generated by the heat pump 80 may be supplied to the inside of the tub 20 through the first duct 101 without being supplied to the second drum 70 of the dryer 60. According to supplying of hot air to the inside of the tub 20, moisture inside the tub 20 and the first drum 30 may be discharged to the lower, rear portion of the tub 20 and move to the second drum 70 of the dryer 60 through the second duct 102. Air may circulate inside the tub 20 of the washing machine 10 and the second housing 61 of the dryer 60.

Also, in the case in which clothes are accommodated inside the first drum 30 of the washing machine 10, a tub drying cycle may be performed to dry the clothes accommodated inside the first drum 30. That is, both washing and drying of clothes may be performed by the washing machine 10. A clothes drying course of the washing machine 10 for drying clothes accommodated inside the first drum 30 of the washing machine 10 may be provided separately from the tub drying course. The clothes drying course and the tub drying course may include different drying settings. For example, in the clothes drying course and the tub drying course, different drying temperatures and/or different drying times may be set.

In the clothes drying course and the tub drying course, the same hot-air supply flow path and the same humidity discharge flow path may be formed. That is, a hot-air supply flow path may be formed by the first duct 101 shown in FIG. 5, and a humidity discharge flow path may be formed by the second duct 102. In the clothes drying course and the tub drying course, the first damper 101*a* may be controlled to open the first duct 101, and the second damper 78 may be controlled to close the guide duct 77.

FIG. 6 shows a cross-section of a clothes treating system according to another embodiment.

Comparing FIG. 6 to FIG. 5, ducts for discharging humidity inside the tub 20 and the first drum 30 may have different structures. However, the second duct 102 of FIG. 5 and the third duct 103 of FIG. 6 may be replaced with each other.

The second duct 102 of FIG. 5 corresponding to a humidity discharge duct may penetrate the guide duct 77 at the upper portion of the rear side 61*b* of the dryer 60. However, the third duct 103 of FIG. 6 corresponding to a humidity discharge duct may be positioned at a lower portion of the first drum 30. The third duct 103 may be positioned between the first drum 30 and the heating duct 76. One end of the third duct 103 may be connected to the lower, rear portion of the tub 20, and another end of the third duct 103 may be connected to the filter duct 75 positioned in front of the first drum 30. The third duct 103 may penetrate the rear side 61*b* of the second housing 61. In the case in which the guide duct 77 is integrated into the second housing 61, the third duct 103 may penetrate the guide duct 77.

Also, in the filter duct 75 of FIG. 6, a third damper 79 for opening or closing the filter duct 75 may be provided. An operation of the third damper 79 may be controlled by the first controller 200 of the washing machine 10 or the second controller 400 of the dryer 60.

While the dryer 60 performs a drying cycle, the third damper 79 may be controlled to open the filter duct 75. During the drying cycle of the dryer 60, the first damper 101*a* may be closed, and the second damper 78 and the third damper 79 may be opened. Accordingly, air may circulate inside the second housing 61 of the dryer 60.

While the washing machine 10 performs a tub drying cycle, the third damper 79 may be controlled to close the filter duct 75. During the tub drying cycle of the washing machine 10, the first damper 101*a* may be opened, and the second damper 78 and the third damper 79 may be closed. According to closing of the third damper 79, humid air flowing into the filter duct 75 through the third duct 103 may be prevented from flowing into the second drum 70 of the dryer 60. That is, humid air discharged from the tub 20 may pass through the heat pump 80 without passing through the second drum 70 of the dryer 60. Accordingly, air may circulate through the heat pump 80 of the dryer 60 and the tub 20 of the washing machine 10.

The third damper 79 may not be an essential component. While the fan 90 operates in a closed state of the second damper 78, humid air flowing into the filter duct 75 through the third duct 103 may flow into the fan 90. Because there is no flow path toward the second drum 70 of the dryer 60, the humid air may not flow into the second drum 70 of the dryer 60.

Also, in the case in which clothes are accommodated inside the first drum 30 of the washing machine 10, a tub drying cycle for drying the clothes accommodated inside the first drum 30 may be performed. That is, both washing and drying of clothes may be performed by the washing machine 19. A clothes drying course of the washing machine 10 for drying clothes accommodated inside the first drum 30 of the washing machine 10 may be provided separately from the tub drying course. The clothes drying course and the tub drying cycle may include different drying settings. For example, in the clothes drying course and the tub drying course, different drying temperatures and/or different drying times may be set.

In the clothes drying course and the tub drying course, the same hot-air supply flow path and the same humidity discharge flow path may be formed. That is, a hot-air supply flow path may be formed by the first duct 101 shown in FIG. 6, and a humidity discharge flow path may be formed by the third duct 103. In the clothes drying course and the tub drying course, the first damper 101*a* may be opened, and the second damper 78 and the third damper 79 may be closed.

Figure 7:
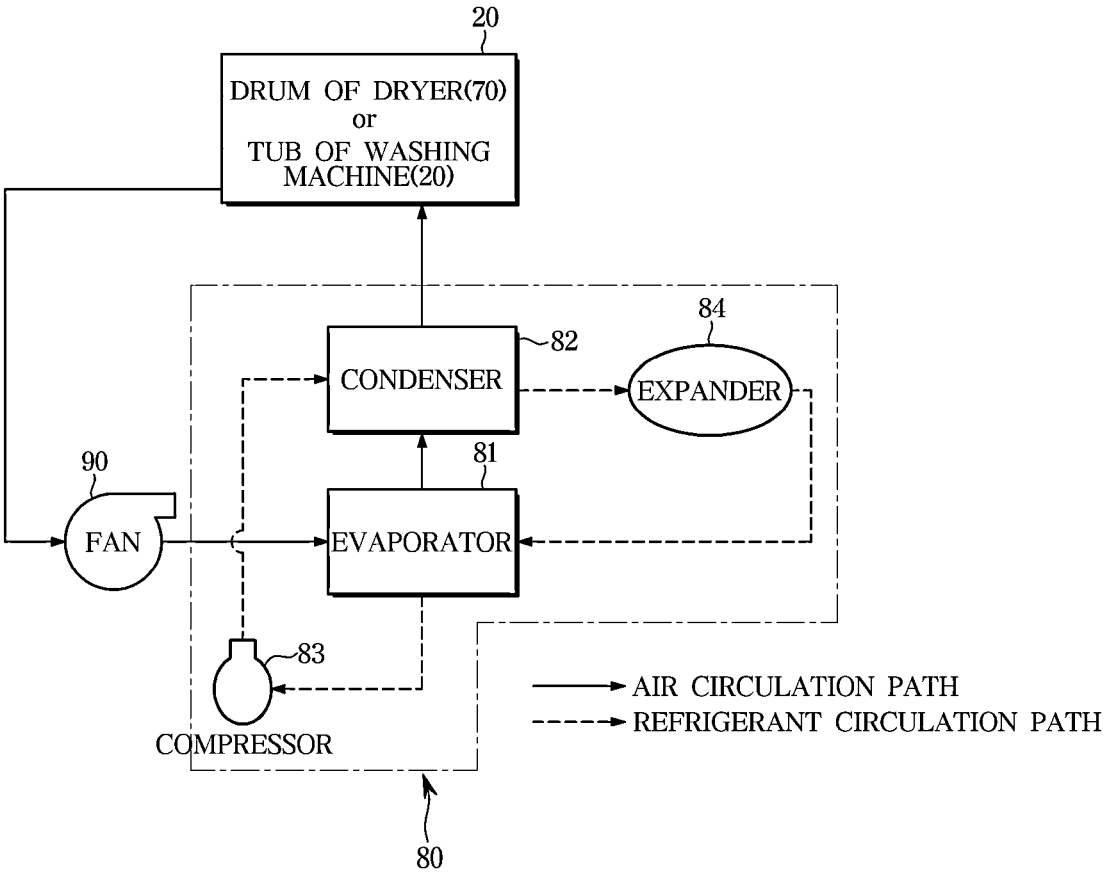
FIG. 7 is a view for describing an operation of a heat pump in a clothes treating system according to an embodiment.

FIG. 7 is a view for describing an operation of a heat pump in a clothes treating system according to an embodiment.

Referring to FIG. 7, the heat pump 80 may include the compressor 83, the condenser 82, the expander 84, and the evaporator 81. The compressor 83, the condenser 82, the expander 84, and the evaporator 81 may be connected to each other by a refrigerant pipe to form a heat pump cycle. A refrigerant may circulate along the heat pump cycle by flowing along the refrigerant pipe. While the compressor 83 operates, the refrigerant may circulate along the refrigerant pipe.

The compressor 83 may compress a low-temperature, low-pressure gaseous refrigerant to a high-temperature, high-pressure gaseous refrigerant and discharge the high-temperature, high-pressure gaseous refrigerant. For example, the compressor 83 may compress the refrigerant through a reciprocating motion of a piston or a rotation motion of a rotor. The discharged gaseous refrigerant may be transferred to the condenser 82.

The condenser 82 may condense the high-temperature, high-pressure gaseous refrigerant into a high-pressure liquid or liquid-like refrigerant below a condensation temperature. The condenser 82 may emit heat to surroundings through a process of condensing the refrigerant. The condenser 82 may heat air through the heat generated in the process of condensing the refrigerant. The liquid refrigerant condensed in the condenser 82 may be transferred to the expander 84. As a driving frequency and/or revolutions per minute (RPM) of the compressor 83 increases, heat emitted to the surroundings of the condenser 82 may increase.

The high-temperature, high-pressure liquid refrigerant condensed in the condenser 82 may be expanded and decompressed in the expander 84. For example, the expander 84 may include a capillary tube and an electronic expansion valve of which an opening degree changes according to an electrical signal, to adjust pressure of a liquid refrigerant. The low-temperature, low-pressure two-phase refrigerant passed through the expander 84 may flow into the evaporator 81.

The evaporator 81 may evaporate the two-phase refrigerant received from the expander 84. As a result, the evaporator 81 may return the low-temperature, low-pressure refrigerant to the compressor 83. The evaporator 81 may absorb heat from surroundings through an evaporation process of changing the low-temperature two-phase refrigerant to a gaseous refrigerant. The evaporator 81 may cool air passing therethrough during the evaporation process.

The surrounding air may be cooled by the evaporator 81, and according to temperature of the surrounding air falling below a dew point, the surrounding air of the evaporator 81 may condense. Water condensed in the evaporator 81 may fall by gravity and be contained in a water container provided at a bottom of the evaporator 81. Some of the water condensed in the evaporator 81 may remain in the evaporator 81 due to surface tension.

Due to condensation around the evaporator 81, absolute humidity of air passing through the evaporator 81 may be lowered. An amount of moisture included in air passing through the evaporator 81 may be reduced. By using condensation around the evaporator 81, the clothes treating system 1 may reduce an amount of moisture included in air inside the drum 70 of the dryer 60 and/or the tub 20 of the washing machine 10.

The evaporator 81 may be positioned upstream of the condenser 82 based on an air flow by the fan 90. Air entered the evaporator 81 from the drum 70 of the dryer 60 or the tub 20 of the washing machine 10 may be dried (condensation of water vapor) by the evaporator 81 while passing through the evaporator 81. Also, the air may decrease in temperature, while passing through the evaporator 81.

The air passed through the evaporator 81 may move toward the condenser 82. While a refrigerant is condensed, the condenser 82 may emit heat, as described above. Accordingly, the air passed through the evaporator 81 may be heated by the condenser 82, while passing through the condenser 82.

The air heated by the condenser 82 may flow into the drum 70 of the dryer 60 or the tub 20 of the washing machine 10. The heated air may absorb moisture, while passing through the drum 70 of the dryer 60 or the tub 20 of the washing machine 10. After the air absorbs moisture, the air may again move to the evaporator 81. Air may remove moisture inside the drum 70 of the dryer 60 and/or the tub 20 of the washing machine 10, while circulating inside the drum 30 of the dryer 60 and/or the tub 20 of the washing machine 10.

Figure 8:
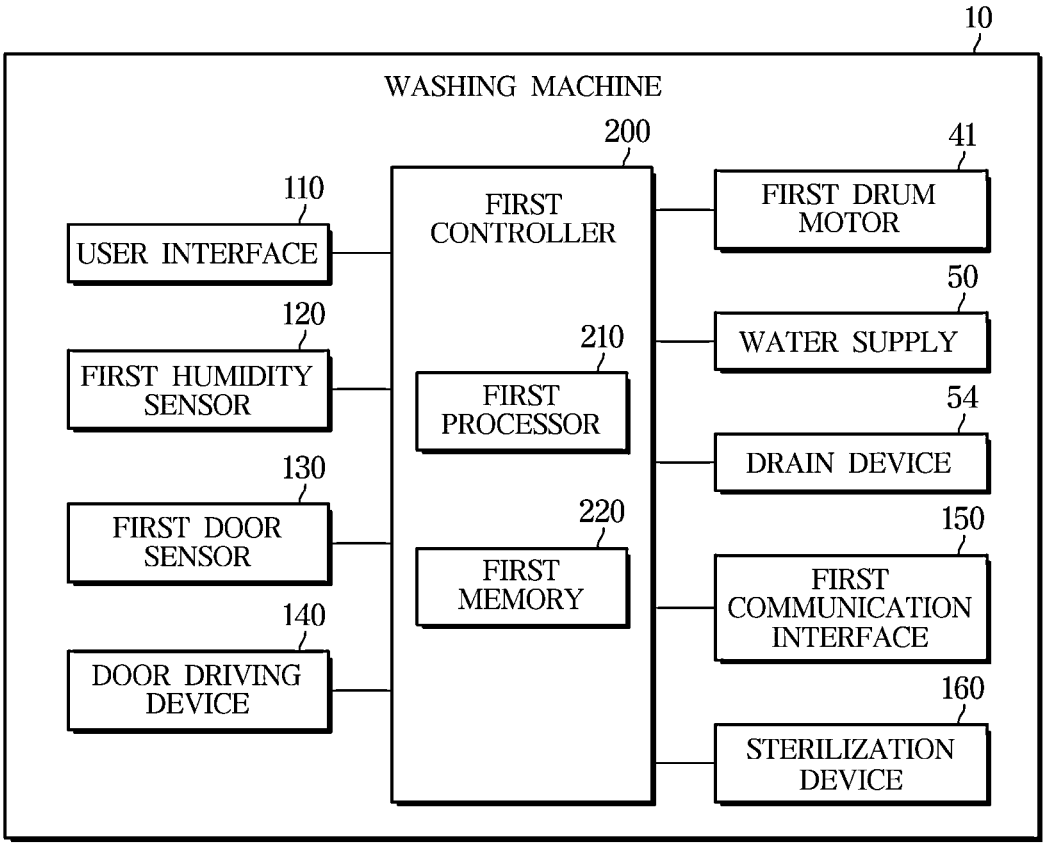
FIG. 8 is a control block diagram of a washing machine according to an embodiment.

FIG. 8 is a control block diagram of a washing machine according to an embodiment.

Referring to FIG. 8, the washing machine 10 may include the first drum motor 41, the water supply 50, the drain device 54, the user interface 110, a first humidity sensor 120, a first door sensor 130, a first communication interface 150, and the first controller 200. Also, the washing machine 10 may include a door driving device 140. The washing machine 10 may include a sterilization device 160.

The first drum motor 41 may generate a driving force for rotating the first drum 30. The first drum motor 41 may rotate the first drum 30 in the clockwise direction or the counterclockwise direction under a control by the first controller 200. The first controller 200 may control the first drum motor 41 to adjust rotation speed of the first drum 30.

The water supply 50 may supply water to the tub 20. The water supply 50 may include a water supply tube 51 extending from an external water supply source to the detergent supply device 53 and/or the tub 20, and a water supply valve 55 for opening or closing the water supply tube 51. The first controller 200 may open or close the water supply valve 52.

The drain device 54 may discharge water accommodated in the tub 20 to the outside. The drain device 54 may include the drain tube 55 extending from the lower portion of the tub 20 to the outside of the first housing 11, the drain valve 56 provided at the drain tube 55 and configured to open or close the drain tube 55, and the pump 57 provided on the drain tube 55. The first controller 200 may open or close the drain valve 56. The first controller 200 may control an operation of the pump 57.

The user interface 110 is shown to be included in the washing machine 10, although not limited thereto. The user interface 110 may be included in the dryer 60. The user interface 110 may be provided as a device that is independent from the washing machine 10 and the dryer 60. Also, a user interface for controlling the washing machine 10 and a user interface for controlling the dryer 60 may be provided separately.

The user interface 110 may obtain a user input for controlling at least one of the washing machine 10 and the dryer 60. The user interface 110 may display various information related to the washing machine 10 and the dryer 60. For example, a user may control the user interface 110 to select a washing course of the washing machine 10 or a drying course of the dryer 60. The user interface 110 may display, based on a selection of a washing course, washing course information and washing setting information (for example, washing temperature, the number of times of rinsing, and strength of dehydrating) corresponding to the washing course. The user interface 110 may display, based on a selection of a drying course, drying course information and drying setting information (for example, drying temperature and drying time) corresponding to the drying course.

The first humidity sensor 120 may detect humidity inside the tub 20 of the washing machine 10. The first humidity sensor 120 may be provided at various locations inside the tub 20. The first humidity sensor 120 may be positioned inside the first drum 30. The first humidity sensor 120 may transmit an electrical signal corresponding to detected humidity to the first controller 200. Whether to perform a tub drying cycle may be identified according to humidity detected by the first humidity sensor 120.

The first door sensor 130 may detect opening and closing of the first door 13. The first door sensor 130 may detect a movement of the first hinge 14. The first door sensor 130 may be provided at a portion of the first door 13 where the first door 12 contacts a front surface of the first housing 11, and/or at a portion of the front surface of the front housing 11. The first door sensor 130 may transmit an electrical signal corresponding to opening and closing of the first door 13 to the first controller 200.

Sensors included in the washing machine 10 are not limited to the above-described sensors. For example, the washing machine 10 may further include various sensors, such as a water level sensor for detecting a water level inside the tub 20, a drum speed sensor for detecting a rotation speed of the first drum 30, a weight sensor for detecting a weight of laundry accommodated in the first drum 30, and/or a vibration sensor for detecting vibration of the tub 20.

The door driving device 140 may adjust an opening angle of the first door 13. The door driving device 140 may be provided together with the first hinge 14. The door driving device 140 may include a gear and motor for rotating the first door 13. The first controller 200 may control the door driving device 140 to automatically open or close the first door 13.

The first communication interface 150 may include various communication circuits for performing wired communication and/or wireless communication with an external device (for example, a server, a user device, and/or another home appliance). The user device may include various electronic devices, such as a smart phone, a notebook, a laptop, a smart watch, a stand-alone tablet, and a speaker. The other home appliance may include the dryer 60. A user input may be obtained through a user device, as well as the user interface 110.

The first communication interface 150 may include at least one of a short-range communication circuit and a long-distance communication circuit. The first communication interface 150 may transmit data to an external device or receive data from an external device. For example, the first communication interface 150 may support cellular communication, wireless local area network (WLAN), Home Radio Frequency (Home RF), infrared communication, Ultra-wide band (UWB) communication, Wireless-Fidelity (Wi-Fi), Wi-Fi Direct, Bluetooth, AD-HOC, and/or Zigbee. Communication technologies supported by the first communication interface 150 are not limited to these examples.

The first communication interface 150 may communicate with an external device through an Access Point (AP). The AP may connect a local area network (LAN) to which the washing machine 10 is connected, to a wide area network (WAN) to which a server is connected.

The sterilization device 160 may sterilize the tub 20 and the first drum 30. For example, the sterilization device 160 may include an ultraviolet light source for irradiating ultraviolet light. The sterilization device 160 may include at least one of a heater, an infrared lamp, or a UV-LED.

The first controller 200 may include a first processor 210 and a first memory 220. The first memory 220 may include a volatile memory (for example, Static Random Access Memory (S-RAM) and Dynamic Random Access (D-RAM)) and a non-volatile memory (for example, Read Only Memory (ROM) and Erasable Programmable Read Only Memory (EPROM). The first processor 210 and the first memory 220 may be implemented as separate chips or a single chip. Also, a plurality of processors and a plurality of memories may be provided. The first processor 210 may process various data and various signals by using instructions, data, programs, and/or software stored in the first memory 220. The first processor 210 may include a single core or a plurality of cores. The first processor 210 may generate a control signal for controlling components of the washing machine 10.

The first controller 200 may be electrically connected to various components of the washing machine 10 and control components of the washing machine 10. The first controller 200 may control the components of the washing machine 10 to perform at least one cycle including supplying water, washing, rinsing, dehydrating, and/or drying according to a user input.

For example, the first controller 200 may perform a tub drying cycle according to a user input of selecting a tub drying course. While the tub drying cycle is performed, the tub 20 and the first drum 30 may be dried. While the tub drying cycle is performed in the state in which clothes are accommodated in the first drum 30, the clothes may be dried together.

Separately from tub drying course, a clothes drying course for drying clothes accommodated inside the first drum 30 of the washing machine 10 may be provided. The first controller 200 may perform a clothes drying cycle according to a user input of selecting the clothes drying course.

Figure 9:
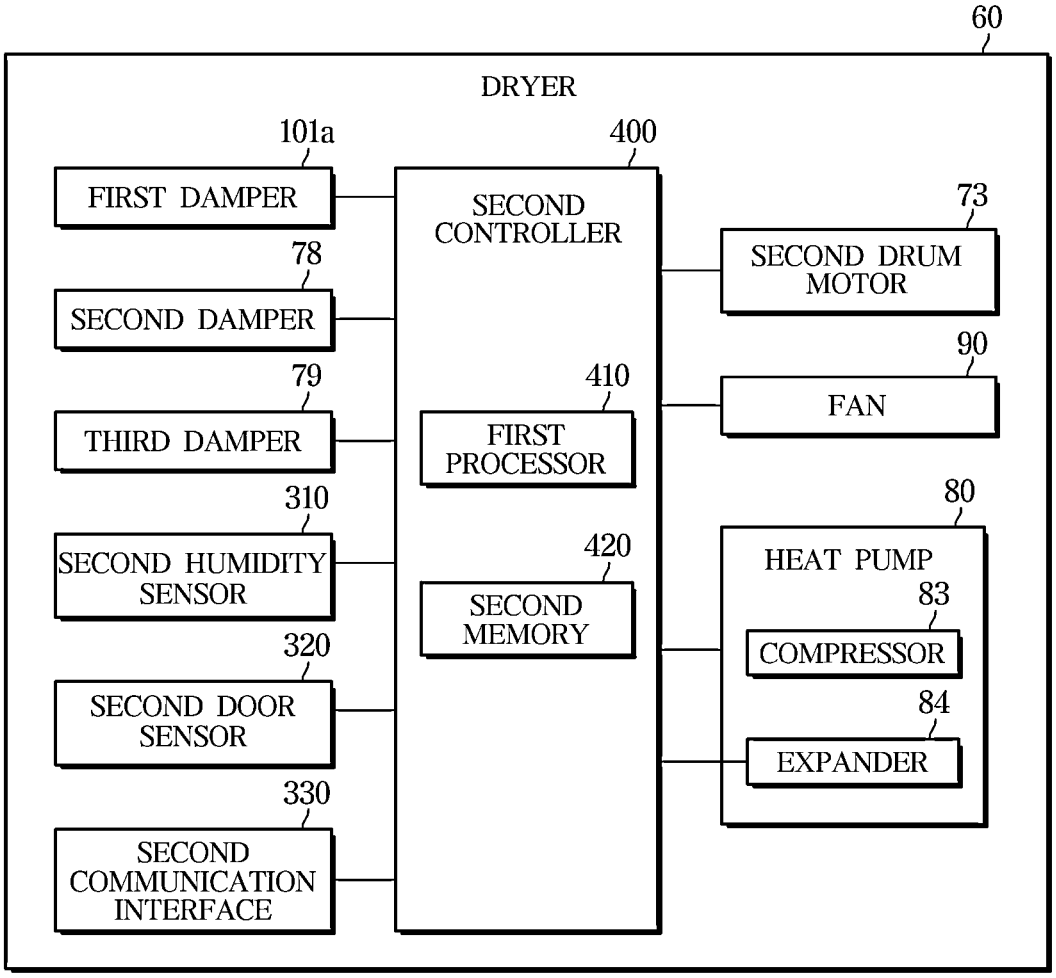
FIG. 9 is a control block diagram of a dryer according to an embodiment.

FIG. 9 is a control block diagram of a dryer according to an embodiment.

Referring to FIG. 9, the dryer 60 may include the second drum motor 73, the heat pump 80, the fan 90, the second humidity sensor 310, the second door sensor 320, the second communication interface 330, and the second controller 400.

The second drum motor 73 may generate a driving force for rotating the second drum 70. The second drum motor 73 may rotate the second drum 70 in the clockwise direction or the counterclockwise direction under a control by the second controller 400. The second controller 400 may control the second drum motor 73 to adjust rotation speed of the second drum 70.

The heat pump 80 may generate hot air. Also, the heat pump 80 may remove moisture included in air passing therethrough. The second controller 400 may control the compressor 83 and the expander 84 included in the heat pump 80. The second controller 400 may adjust a driving frequency and/or RPM of the compressor 83. The second controller 400 may adjust an opening rate of the expander 84.

The fan 90 may cause air to flow. For example, during a tub drying cycle, air flowing by an operation of the fan 90 may circulate along the tub 20 of the washing machine 10 and the second drum 70 of the dryer 60. The second controller 400 may adjust a rotation speed of the fan 90.

The second humidity sensor 310 may detect humidity inside the second drum 70 of the dryer 60. The second humidity sensor 310 may be provided at various locations inside the second drum 70. The second humidity sensor 310 may transmit an electrical signal corresponding to detected humidity to the second controller 400. Whether to terminate a drying cycle may be identified according to humidity detected by the second humidity sensor 310.

The second door sensor 320 may detect opening and closing of the second door 63. The second door sensor 320 may detect a movement of the second hinge 64. The second door sensor 320 may be provided at a portion of the second door 63 where the second door 63 contacts a front surface of the second housing 61, and/or at a portion of the front surface of the second housing 61. The second door sensor 320 may transmit an electrical signal corresponding to opening and closing of the second door 63 to the second controller 400.

Sensors included in the dryer 60 are not limited to the above-described sensors. For example, the dryer 60 may further include a weight sensor for detecting a weight of an object accommodated in the second drum 70, a temperature sensor for detecting temperature inside the second drum 70, a vibration sensor for detecting vibration of the second housing 61, and/or a drum speed sensor for detecting rotation speed of the second drum 70.

The second communication interface 330 may include various communication circuits for performing wired communication and/or wireless communication with an external device (for example, a server, a user device, and/or another home appliance). The other home appliance may include the washing machine 10. The second communication interface 330 may include at least one of a short-range communication circuit or a long-distance communication circuit. The second communication interface 330 may transmit data to an external device or receive data from an external device. For example, the second communication interface 330 may support cellular communication, WLAN, Home RF, infrared communication, UWB communication, Wi-Fi, Wi-Fi Direct, Bluetooth, AD-HOC, and/or Zigbee. Communication technologies supported by the second communication interface 330 are not limited to these examples.

The second communication interface 330 may communicate with an external device through an AP. The AP may connect a LAN to which the dryer 60 is connected to a WAN to which a server is connected. The dryer 60 may be connected to the server through the WAN.

The second controller 400 may include a second processor 410 and a second memory 420. The second memory 420 may include a volatile memory (for example, S-RAM and D-RAM) and a non-volatile memory (for example, ROM and EPROM). The second processor 410 and the second memory 420 may be implemented as separate chips or a single chip. Also, a plurality of processors and a plurality of memories may be provided. The second processor 410 may process various data and various signals by using instructions, data, programs, and/or software stored in the second memory 420. The second processor 410 may include a single core or a plurality of cores. The second processor 410 may generate a control signal for controlling components of the dryer 60.

The second controller 400 may be electrically connected to various components of the dryer 60, and control the components of the dryer 60. The second controller 400 may control components of the washing machine 10 to perform a drying operation according to a user input.

The second controller 400 of the dryer 60 may control a first damper 101*a*, a second damper 78, and a third damper 79. An example in which the first damper 101*a*, the second damper 78, and the third damper 79 are controlled by the second controller 400 of the dryer 60 is described. However, the disclosure is not limited thereto, and the first damper 101*a*, the second damper 78, and the third damper 79 may be controlled by the first controller 200 of the washing machine 10.

Figure 10:
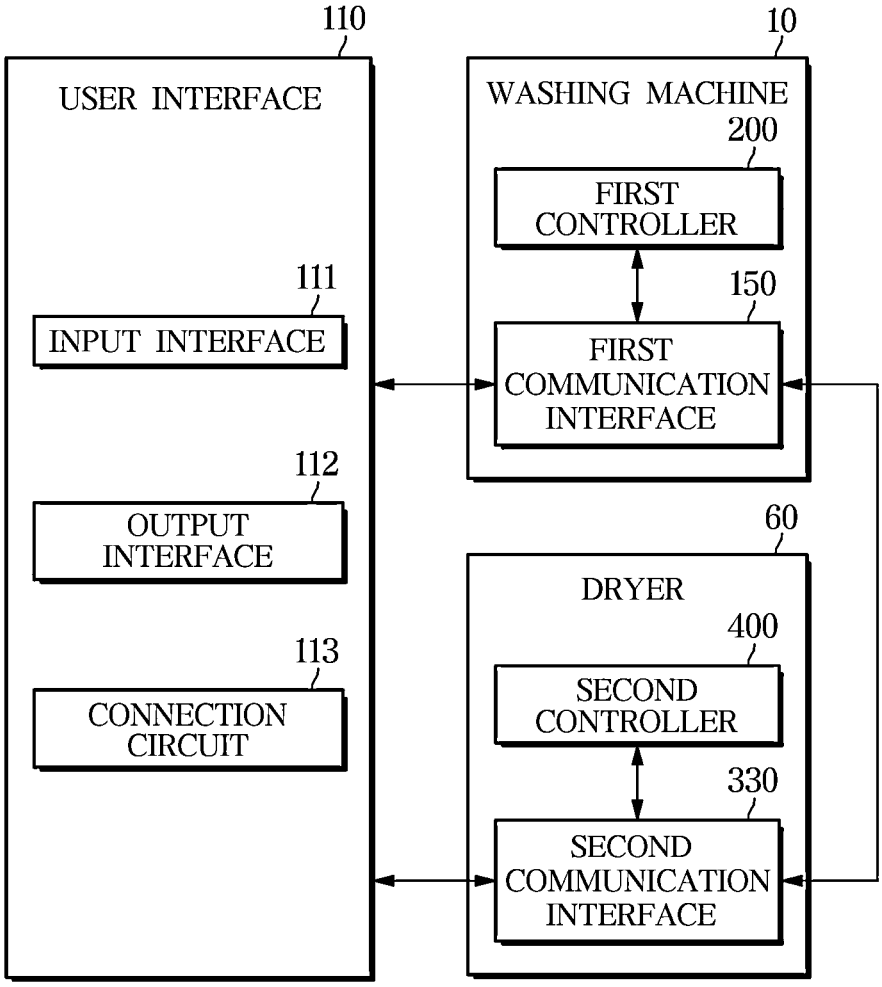
FIG. 10 is a control block diagram of a clothes treating system according to an embodiment.

FIG. 10 is a control block diagram of a clothes treating system according to an embodiment.

Referring to FIG. 10, the clothes treating system 1 may include the washing machine 10, the dryer 60, and the user interface 110. The washing machine 10 may be electrically connected to the dryer 60. The washing machine 10 and the dryer 60 may transmit/receive an electrical signal (for example, a control signal), information, and/or data to/from each other.

The washing machine 10 and the dryer 60 may communicate with each other through the first communication interface 150 and the second communication interface 330. For example, the first communication interface 150 and the second communication interface 330 may directly communicate with each other by using a Device-to-Device (D2D) wireless communication module (for example, Bluetooth module). The first communication interface 150 and the second communication interface 330 may be connected to a WAN and communicate with each other through a server.

A connection circuit 113 for wired connection between the first communication interface 150 and the second communication interface 330 may be provided. The connection circuit 113 may include a connector for connecting the first communication interface 150 to the second communication interface 330.

The connection circuit 113 may transfer a signal transmitted from the first controller 200 through the first communication interface 150 to the second controller 400 through the second communication interface 330. The connection circuit 113 may transfer a signal transmitted from the second controller 400 through the second communication interface 330 to the first controller 200 through the first communication interface 150.

The first controller 200 of the washing machine 100 may generate a control signal for controlling at least one component of the dryer 60, as well as a control signal for controlling components of the washing machine 10. The second controller 400 of the dryer 60 may generate a control signal for controlling at least one component of the washing machine 10, as well as a control signal for controlling components of the dryer 60.

The user interface 110 may be provided in the washing machine 10 and/or the dryer 60. For example, the user interface 110 may be provided between the washing machine 10 and the dryer 60 arranged vertically. The user interface 110 may be positioned at the front, upper portion of the first housing 11 of the washing machine 10.

The user interface 110 may be provided as a single interface capable of controlling the washing machine 10 and the dryer 60 in an integrated manner, although not limited thereto. However, a user interface for controlling the washing machine 10 and a user interface for controlling the dryer 60 may be provided separately.

The user interface 110 may include an input interface 111, an output interface 112, and the connection circuit 113. Also, the user interface 110 may include a controller capable of controlling both the washing machine 10 and the dryer 60.

The input interface 111 may obtain a user input. The input interface 111 may transmit an electrical signal corresponding to a user input to the first controller 200 of the washing machine 10 and/or the second controller 400 of the dryer 60. The input interface 111 may include various buttons and/or a rotatable dial.

The output interface 112 may include at least one of a display and a speaker. The output interface 112 may be provided as a Liquid Crystal Display (LCD) panel and/or a Light Emitting Diode (LED) panel. The output interface 112 may include a touch display.

The output interface 112 may receive information related to an operation of the washing machine 10 from the first controller 200 through the first communication interface 150 of the washing machine 10. The output interface 112 may receive information related to an operation of the dryer 60 from the second controller 400 through the second communication interface 330 of the dryer 60.

The output interface 112 may output various information related to an operation of the clothes treating system 1. The output interface 112 may display information related to an operation of the washing machine 10 and information related to an operation of the dryer 60. For example, the output interface 112 may display a washing course, a detailed setting for washing, a washing time, a drying course, a detailed setting for drying, and/or a drying time.

The output interface 112 may display, based on a selection of a washing course for operating the washing machine 10 through the input interface 111, washing course information and washing setting information (for example, a washing temperature, the number of times of rinsing, and strength of dehydrating) corresponding to the washing course. The output interface 112 may display, based on a selection of a drying course for operating the dryer 60 through the input interface 111, drying course information and drying setting information (for example, a drying temperature and a drying time) corresponding to the drying course.

As described above, the clothes treating system 1 may perform a tub drying cycle for removing moisture inside the tub 20 and the first drum 30 of the washing machine 10. The user interface 110 may receive a user input of selecting the tub drying course. According to a selection of the tub drying course, the first controller 200 or the second controller 400 may identify whether to perform a tub drying cycle based on humidity inside the tub 20, detected by the first humidity sensor 120.

The first controller 200 or the second controller 400 may perform a tub drying cycle based on detected humidity inside the tub 20 being higher than or equal to preset reference humidity. The reference humidity may be set to various values depending on a design. A tub drying cycle may be automatically performed based on humidity inside the tub 20 being higher than or equal to the preset reference humidity, although the tub drying course is not selected through the user interface 110.

The first controller 200 or the second controller 400 may control the first humidity sensor 120 to detect humidity inside the tub 20 while the first door 13 of the washing machine 10 is closed. By detecting humidity inside the tub 20 while the first door 13 is closed, accuracy of humidity detection may increase. The first controller 200 or the second controller 400 may identify opening or closing of the first door 13 based on a signal transmitted from the first door sensor 130.

The first controller 200 or the second controller 400 may identify whether to perform a tub drying cycle after an operation of the washing machine 10 related to washing of laundry accommodated in the first drum 30 is completed. The first controller 200 or the second controller 400 may identify completion of an operation of the washing machine 10 related to washing of laundry. For example, after a washing cycle corresponding to a washing course selected through the user interface 110 is completed, the first controller 200 or the second controller 400 may identify whether a tub drying cycle needs to be performed. The first controller 200 or the second controller 400 may control the first humidity sensor 120 to detect humidity inside the tub 20, in the state in which the first door 13 is closed after a washing cycle is completed.

The state in which the first door 13 is closed after the washing cycle is completed may include a state in which the first door 13 is closed while laundry remains in the first drum 30 and a state in which the first door 13 is closed after laundry is discharged from the first drum 30.

By performing a tub drying cycle of the washing machine 10 while laundry remains in the first drum 30, an effect of removing water vapor floating inside the tub 20 and the first drum 30 may be achieved. Also, the laundry accommodated inside the first drum 30 may be dried.

By performing a tub drying cycle after laundry is discharged from the first drum 30, an effect of drying the entire of the tub 20 and the first drum 30 may be achieved.

A drying setting of a tub drying cycle while laundry exists inside the first drum 30 may be different from a drying setting of a tub drying cycle while there is no laundry inside the first drum 30. For example, while laundry exists in the first drum 30, the first controller 200 or the second controller 400 may set a drying temperature to a relatively high temperature. While laundry exists in the first drum 30, the first controller 200 or the second controller 400 may set a drying time to a relatively long time. Also, the first controller 200 or the second controller 400 may adjust a rotation speed of the first drum 30, an operating frequency of the compressor 83, and/or a rotation speed of the fan 90 in a tub drying cycle, depending on whether laundry exists inside the first drum 30.

The first controller 200 or the second controller 400 may open, according to identifying that a tub drying cycle needs to be performed, the first damper 101*a* provided in the first duct 101 and operate the heat pump 80 and the fan 90. Operating the heat pump 80 may include operating the compressor 83 and controlling the expander 84. Accordingly, hot air generated by the heat pump 80 may flow into the tub 20 through the first duct 101, and humidity inside the tub 20 may flow into the second housing 61 of the dryer 60 through the second duct 102.

The first controller 200 or the second controller 400 may close, according to identifying that a tub drying cycle needs to be performed, the second damper 78 provided in the guide duct 77 to prevent hot air from being supplied to the second drum 70. As a result of closing of the second damper 78, hot air may be prevented from flowing into the guide duct 77, and thus, the supply of hot air to the second drum 70 of the dryer 60 may be blocked. Accordingly, heat loss may be reduced.

In the case in which the clothes treating system 1 has the structure in which the humidity discharge duct (the third duct 103 of FIG. 6) is connected to the filter duct 75 (see FIG. 6), the first controller 200 or the second controller 400 may close, according to identifying that a tub drying cycle needs to be performed, the third damper 79 provided in the filter duct 75 to prevent moisture from flowing into the second drum 70 through the filter duct 75. However, the third damper 79 may not correspond to an essential component as described above.

Also, the first controller 200 or the second controller 400 may control the first drum motor 41 to rotate the first drum 30 of the washing machine 10 during a tub drying cycle. The first controller 200 or the second controller 400 may control the second drum motor 73 to stop rotating the second drum 70 of the dryer 60 during the tub drying cycle. While the first drum 30 of the washing machine 10 rotates, hot air may affect the entire of the first drum 30. Accordingly, a drying effect of the first drum 30 may be improved.

The first controller 200 or the second controller 400 may stop, based on humidity inside the tub 20 becoming lower than the preset reference humidity while a tub drying cycle is performed, operating the heat pump 80 and the fan 90. That is, according to humidity inside the tub 20 becoming lower than the preset reference humidity, the compressor 83 may stop operating. Also, according to humidity inside the tub 20 becoming lower than the preset reference humidity, the first drum 30 may also stop rotating.

The first controller 200 or the second controller 400 may control the door driving device 140 to open the first door 13 of the washing machine 10 based on completion of the tub drying cycle. The clothes treating system 1 may lower temperature of the tub 20 and improve a drying effect of the tub 20 by automatically opening the first door 13 of the washing machine 10 after removing water vapor and/or moisture inside the tub 20 of the washing machine 10.

Meanwhile, the user interface 110 may obtain a user input of selecting the clothes drying course for drying laundry accommodated in the first drum 30 of the washing machine 10. According to the selection of the clothes drying course, the first controller 200 or the second controller 400 may identify whether to perform a clothes drying cycle based on humidity inside the tub 20 detected by the first humidity sensor 120 and whether laundry exists inside the first drum 30.

Whether laundry exists inside the first drum 30 may be identified by various methods. For example, whether laundry exists inside the first drum 30 may be identified by using a weight sensor, vibration of the tub 20, and/or a rotation speed of the first drum 30. Also, a clothes drying cycle may be automatically performed according to humidity inside the tub 20 and whether laundry exists in the first drum 30.

The clothes drying course and the tub drying course may include different drying settings. For example, in the clothes drying course and the tub drying course, different drying temperatures and/or different drying times may be set. Also, in the clothes drying course and the tub drying course, different rotation speeds of the first drum 30, different operating frequencies of the compressor 83, and/or different rotation speeds of the fan 90 may be set.

Figure 11:
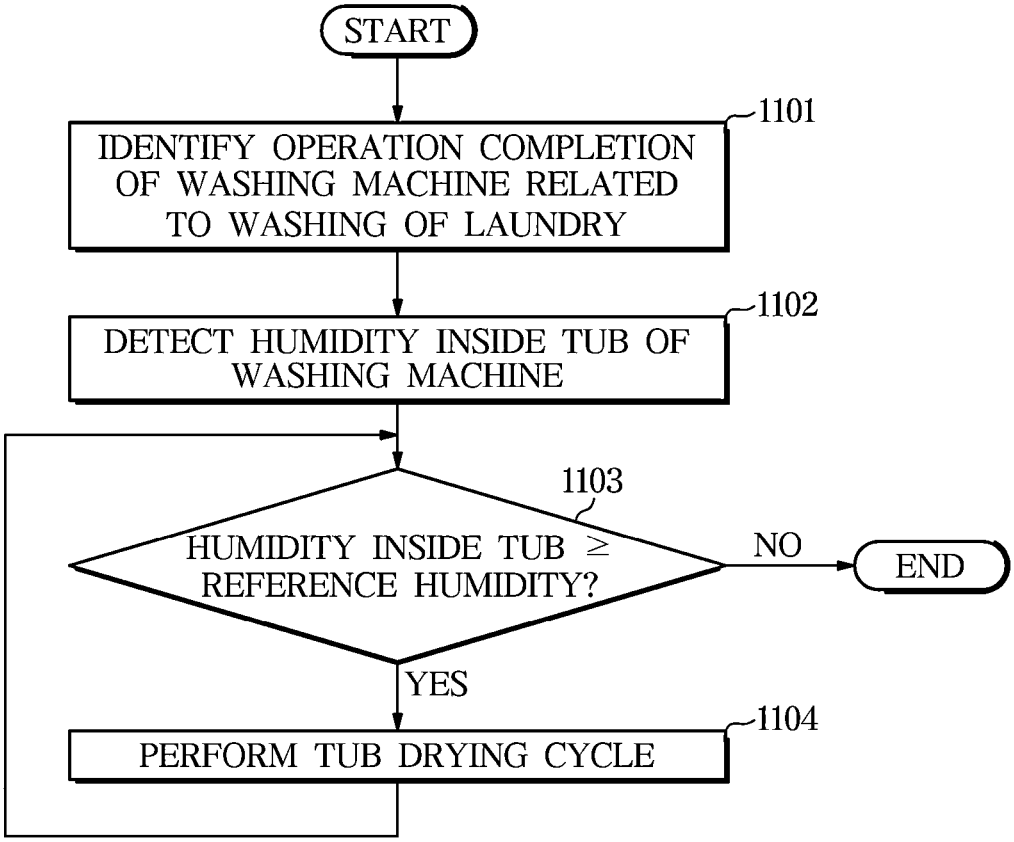
FIG. 11 is a flowchart for describing a method of controlling a clothes treating system according to an embodiment.

FIG. 11 is a flowchart for describing a method of controlling a clothes treating system according to an embodiment.

Referring to FIG. 11, the first controller 200 of the clothes treating system 1 may identify operation completion of the washing machine 10 related to washing of laundry (1101). For example, the first controller 200 may identify completion of a washing cycle of the washing machine 10.

The first controller 200 may control the first humidity sensor 120 to detect humidity inside the tub 20 of the washing machine 10 (1102). The first controller 200 may control the first humidity sensor 120 to detect humidity inside the tub 20 in the state in which the first door 13 is closed. For example, humidity inside the tub 20 may be detected in the state in which laundry remains in the first drum 30 and the first door 13 is closed. Humidity inside the tub 20 may be detected in the state in which the first door 13 is closed after laundry is discharged from the first drum 30.

The first controller 200 may compare the humidity inside the tub 20 detected by the first humidity sensor 120 to the preset reference humidity (1103). Based on the detected humidity inside the tub 20 being higher than or equal to the preset reference humidity, the first controller 200 may perform a tub drying cycle (1104).

Based on the detected humidity inside the tub 20 being higher than or equal to the preset reference humidity, the first controller 200 may not perform a tub drying cycle. While the tub drying cycle is performed, humidity inside the tub 20 may become lower than the preset reference humidity, and at this time, the first controller 200 or the second controller 400 may terminate the tub drying cycle.

According to a tub drying cycle being performed in the washing machine 10 while laundry remains in the first drum 30, an effect of removing water vapor floating inside the tub 20 and the first drum 30 may be achieved. Accordingly, even though the first door 13 opens immediately after an operation of the washing machine 10 related to washing of laundry is completed, it may be possible to prevent a large amount of water vapor inside the tub 20 from being discharged to an indoor space.

According to a tub drying cycle being performed after laundry is discharged from the first drum 30, an effect of drying the entire of the tub 20 and the first drum 30 may be achieved. That is, water remaining in the tub 20 and the first drum 30 may be removed, and the tub 20 and the first drum 30 may be maintained clean.

Figure 12:
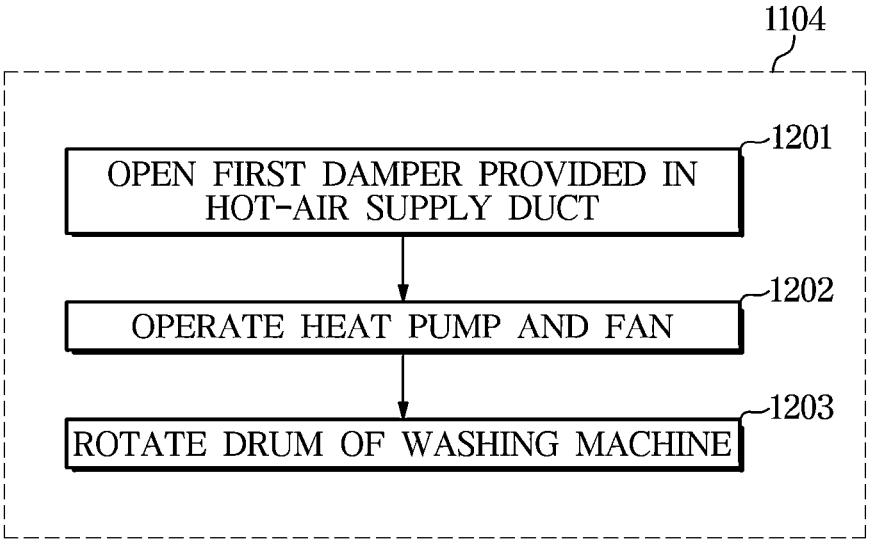
FIG. 12 is a flowchart for describing a first embodiment of a tub drying cycle described in FIG. 11.

FIG. 12 is a flowchart for describing a first embodiment of a tub drying cycle described in FIG. 11.

Referring to FIG. 12, the first controller 200 of the clothes treating system 1 may open the first damper 101*a* provided in the hot-air supply duct (that is, the first duct 101) based on entering a tub drying cycle (1201). The first damper 101*a* may be opened by the second controller 200.

The first controller 200 may operate the heat pump 80 and the fan 90 to generate hot-air (1202). The first controller 200 may directly control the heat pump 80 and the fan 90, or transmit a control signal for operating the heat pump 80 and the fan 90 to the second controller 400. Operating the heat pump 80 may include operating the compressor 83 and controlling the expander 84. Accordingly, hot-air generated by the heat pump 80 may flow into the tub 20 through the first duct 101, and moisture inside the tub 20 may flow into the second housing 61 of the dryer 60 through the second duct 102.

Also, the first controller 200 may control the first drum motor 41 for rotating the first drum 30 of the washing machine 10 (1203). While the first drum 30 of the washing machine 10 rotates, hot-air may affect the entire of the first drum 30. Accordingly, an effect of drying the first drum 30 may be improved.

According to humidity inside the tub 20 becoming lower than reference humidity by performing the tub drying cycle, the first controller 200 or the second controller 400 may stop operating the heat pump 80 and the fan 90. Also, the first controller 200 or the second controller 400 may stop rotating the first drum 30.

Figure 13:
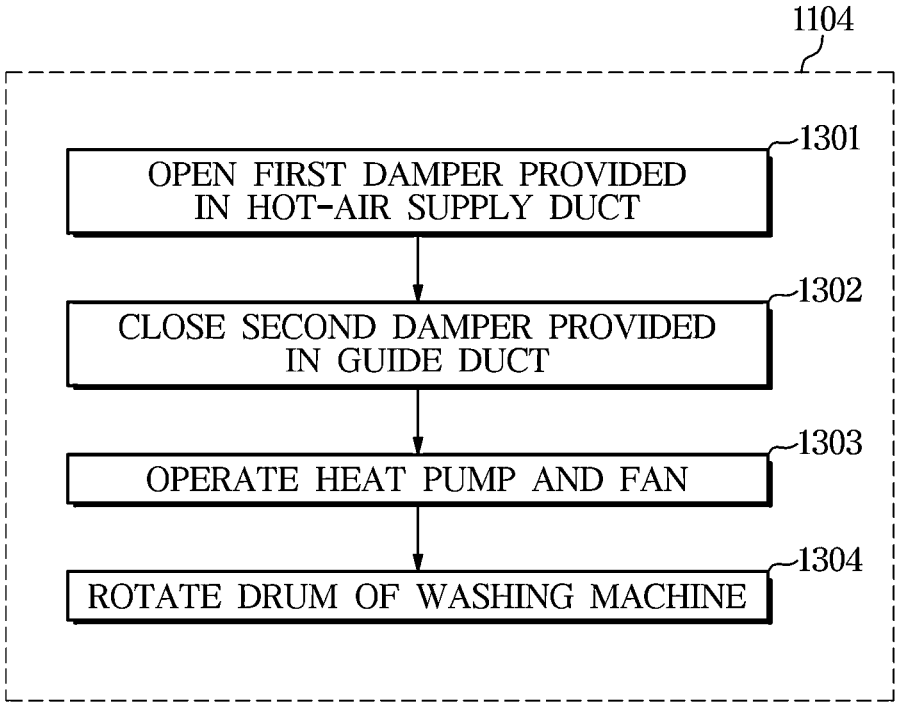
FIG. 13 is a flowchart for describing a second embodiment of a tub drying cycle described in FIG. 11.

FIG. 13 is a flowchart for describing a second embodiment of a tub drying cycle described in FIG. 11.

Referring to FIG. 13, the first controller 200 of the clothes treating system 1 may open the first damper 101*a* provided in the hot-air supply duct (that is, the first duct 101) based on entering a tub drying cycle (1301). Also, the first controller 200 may close the second damper 78 provided in the guide duct 77 (1302). According to closing of the second damper 78, hot air may not flow into the guide duct 77, and supply of hot air to the second drum 70 of the dryer 60 may be blocked. Accordingly, heat loss may be reduced.

Opening the first damper 101 and closing the second damper 78 may be performed by the second controller 200.

The first controller 200 or the second controller 400 may operate the heat pump 80 and the fan 90 to generate hot air (1303). Also, the first controller 200 may control the first drum motor 41 to rotate the first drum 30 of the washing machine 10 (1304).

Figure 14:
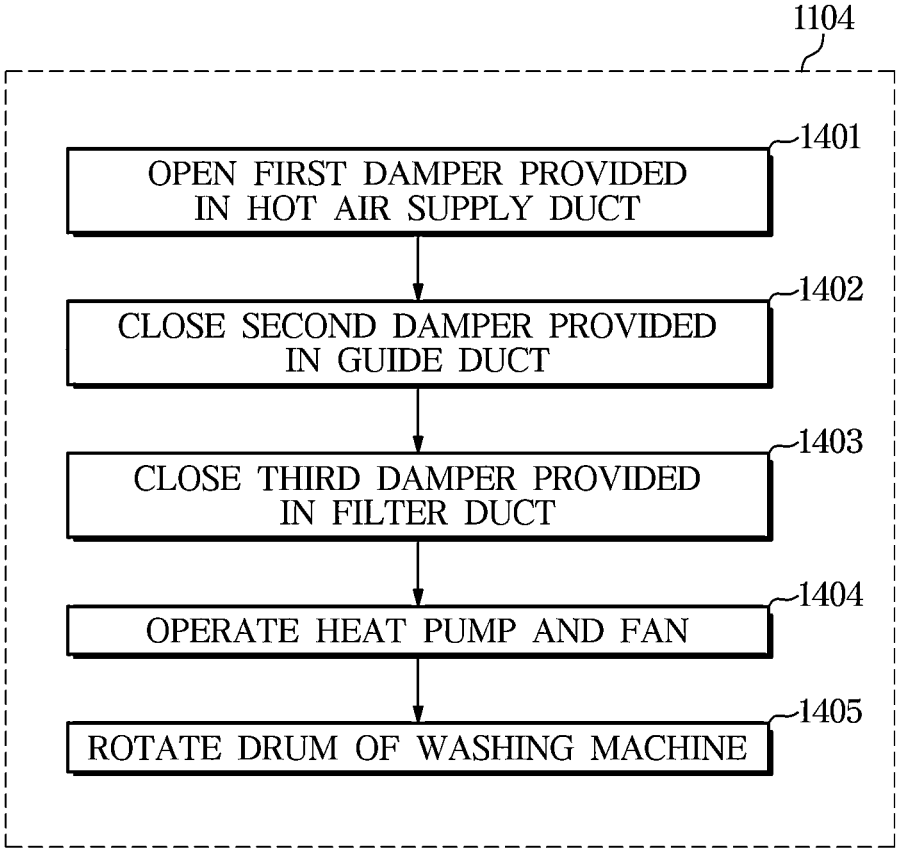
FIG. 14 is a flowchart for describing a third embodiment of a tub drying cycle described in FIG. 11.

FIG. 14 is a flowchart for describing a third embodiment of a tub drying cycle described in FIG. 11.

The third embodiment of a tub drying cycle may be performed in the case in which the clothes treating system 1 has a structure in which the moisture discharge duct (the third duct 103 of FIG. 6) is connected to the filter duct 75 (see FIG. 6).

Referring to FIG. 14, the first controller 200 of the clothes treating system 1 may open the first damper 101*a* provided in the hot air supply duct (that is, the first duct 101) based on entering a tub drying cycle (1401). The first controller 200 may close the second damper 78 provided in the guide duct 77 (1402). Also, the first controller 200 may close the third damper 79 provided in the filter duct 75 (1403). According to closing of the third damper 79, moisture may be prevented from flowing into the second drum 70 through the filter duct 75.

Opening the first damper 101, closing the second damper 78, and closing the third damper 79 may be performed by the second controller 200.

The first controller 200 or the second controller 400 may operate the heat pump 80 and the fan 90 to generate hot air (1404). Also, the first controller 200 may control the first drum motor 41 to rotate the first drum 30 of the washing machine 10 (1405).

As described above, the third damper 79 may not be an essential component. According to an operation of the fan 90 while the second damper 78 is closed, humid air flowing into the filter duct 75 through the third duct 103 may flow into the fan 90. Because there is no flow path toward the second drum 70 of the dryer 60, the humid air may not flow into the second drum 70 of the dryer 60. The third damper 79 may completely prevent humid air from flowing into the second drum 70 of the dryer 60.

As such, by removing water vapor and/or humidity remaining in the tub 20 and the first drum 30 of the washing machine 10, the clothes treating system 1 may maintain the tub 20 and the first drum 30 clean. That is, by performing a tub drying cycle, the clothes treating system 1 may suppress the growth of mold and bacteria in the tub 20 and the first drum 30. Also, the clothes treating system 1 may prevent a large amount of water vapor inside the tub 20 from being discharged to an indoor space immediately after an operation of the washing machine 10 related to washing of laundry is completed, thereby suppressing the growth of mold and bacteria in the indoor space.

Figure 15:
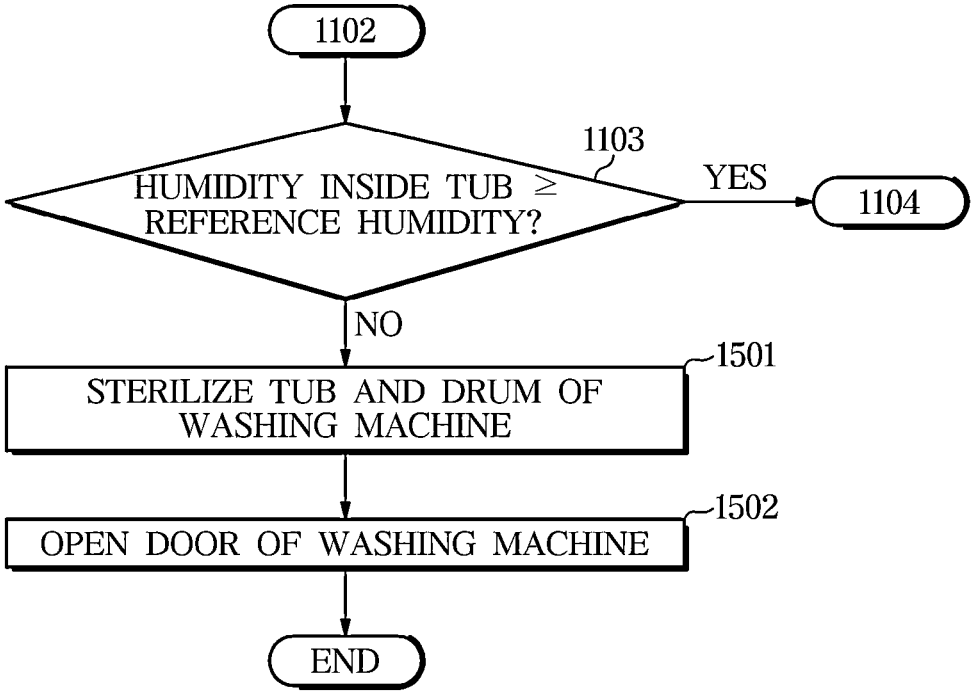
FIG. 15 is a flowchart for describing a method of controlling a clothes treating system, following the method of FIG. 11.

FIG. 15 is a flowchart for describing a method of controlling a clothes treating system, following the method of FIG. 11.

Referring to FIG. 15, the first controller 200 of the clothes treating system 1 may control the first humidity sensor 120 to detect humidity inside the tub 20 of the washing machine 10 (1102). According to humidity inside the tub 20 detected by the first humidity sensor 120 being lower than the reference humidity, the first controller 200 may control the sterilization device 160 to sterilize the tub 20 and the first drum 30 of the washing machine 10 (1501). The tub 20 and the first drum 30 may be sterilized for a preset sterilization time.

For example, the sterilization apparatus 160 may include an ultraviolet light source that irradiates ultraviolet light. The sterilization apparatus 160 may include at least one of a heater, an infrared lamp, or a UV-LED.

Also, according to completion of sterilization, the first controller 200 or the second controller 400 may control the door driving device 140 to open the first door 13 of the washing machine 10 (1502). By removing water vapor and/or moisture inside the tub 20 of the washing machine 10 and then automatically opening the first door 13 of the washing machine 10, the clothes treating system 1 may lower temperature of the tub 20 and improve a drying effect of the tub 20.

Figure 16:
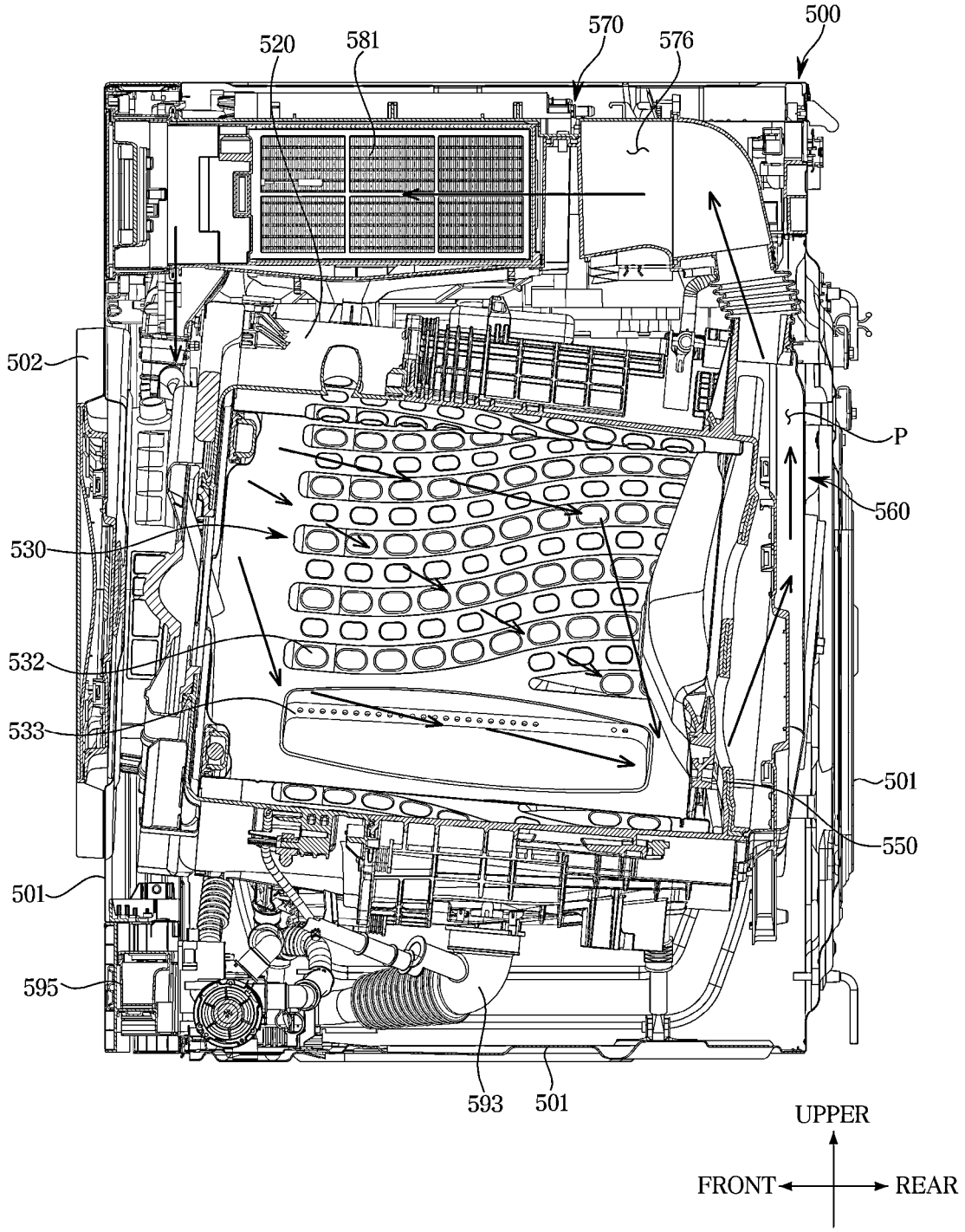
FIG. 16 shows a cross-section of a clothes treating system according to another embodiment.
Figure 17:
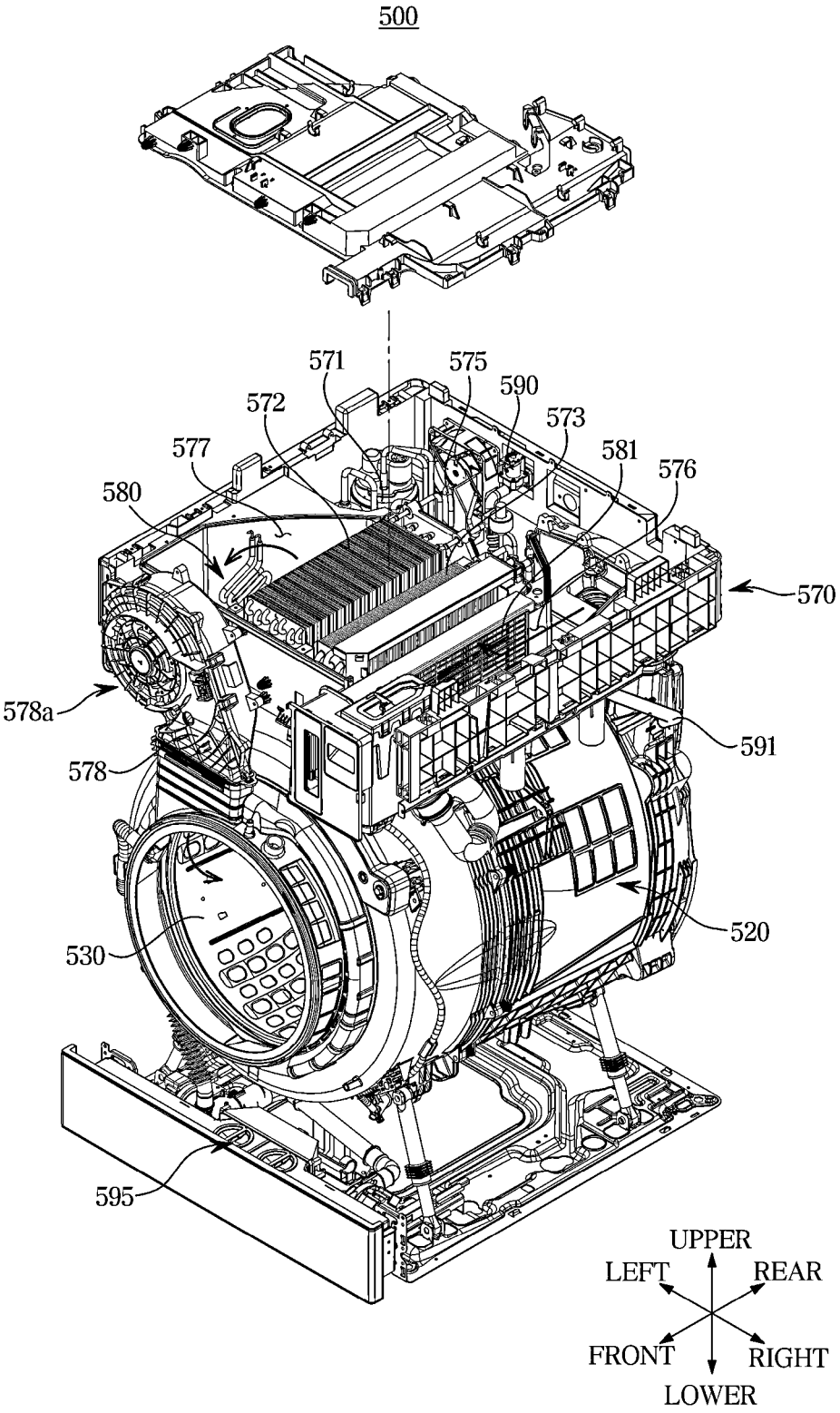
FIG. 17 three-dimensionally shows an internal structure of the clothes treating system shown in FIG. 16.
Figure 18:
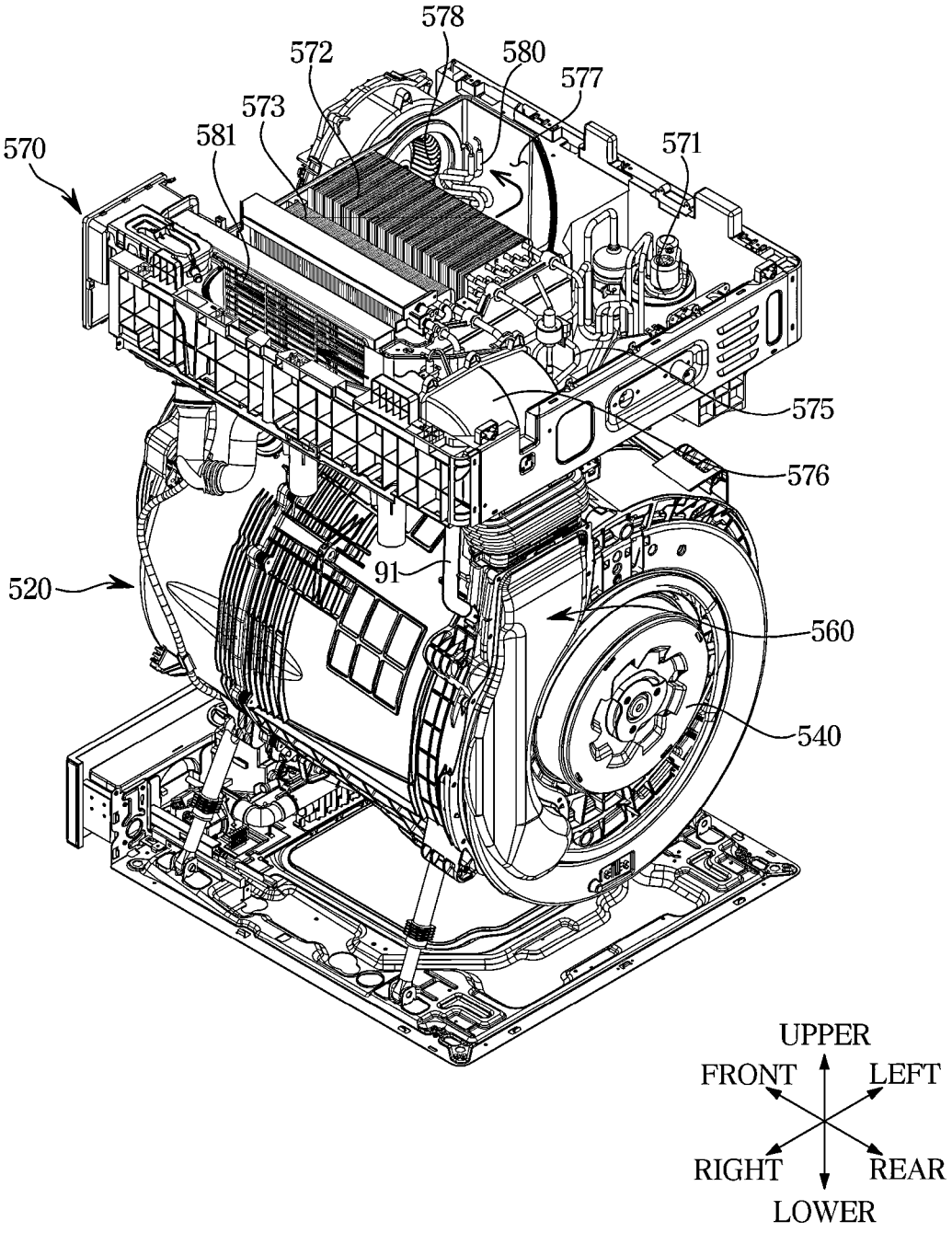
FIG. 18 three-dimensionally shows the internal structure of the clothes treating system shown in FIG. 16 in another direction.

FIG. 16 shows a cross-section of a clothes treating system according to another embodiment. FIG. 17 three-dimensionally shows an internal structure of the clothes treating system shown in FIG. 16. FIG. 18 three-dimensionally shows the internal structure of the clothes treating system shown in FIG. 16 in another direction.

Referring to FIGS. 16, 17, and 18, a clothes treating system 500 according to another embodiment is also referred to as a 'washing machine with a drying function'. The clothes treating system 500 according to another embodiment may include a housing 501 forming an outer appearance, a tub 520 that accommodates washing water or rinsing water to be used for a washing cycle or a rinsing cycle, a drum 530 that accommodates laundry, and a driving motor 540 for rotating the drum 530. The housing 501 may be formed as a hexahedron.

In a front side of the housing 501, an inlet (not shown) through which laundry is put into or taken out of the drum 530 may be formed. The inlet (not shown) may be opened or closed by a door 502 installed on the front side of the housing 501. On a front, upper side of the housing 501, a user interface for controlling operations of the clothes treating system 500 may be provided.

A water supply 590 for supplying washing water to the tub 520 may be positioned above the tub 520. The water supply 590 may be positioned behind a dryer 570. The water supply 590 may include a water supply guide 591 and a water supply valve (not shown). The water supply guide 591 may guide water from the water supply valve (not shown) to the tub 520.

The clothes treating system 500 may include a detergent supply device 595 for supplying a detergent to the tub 520. A drain device 593 for discharging washing water used for washing to the outside of the housing 501 may be positioned below the tub 520. Inside the tub 520, a humidity sensor for detecting humidity may be provided.

In the drum 530 having a cylindrical shape, a plurality of through holes 532 through which washing water flows may be formed. On an inner circumferential surface of the drum 530, a plurality of lifters 533 may be installed to lift and drop laundry while the drum 530 rotates.

The dryer 570 may be configured to dry clothes accommodated inside the drum 530 by drying and heating air discharged from the tub 520 and circulating the heated air to the inside of the tub 520. The dryer 570 may be provided above the tub 520. The dryer 570 may include a heat pump. The dryer 570 may include a compressor 571, a condenser 572, an evaporator 573, an expansion valve (not shown), and a refrigerant tube 575 through which a refrigerant circulates to be heat-exchanged. Also, the dryer 570 may further include a heater 580 in addition to the heat pump to increase drying efficiency.

The dryer 570 may be positioned above the tub 520. Above the tub 520, an inlet duct 576 through which air flows into the dryer 570, a heating duct 577 on which the condenser 572 and the evaporator 573 are positioned, and a supply duct 578 through which air heated in the dryer 570 is supplied into the drum 530 may be positioned.

Air passed through the inside of the tub 520 may flow into the dryer 570 through the inlet duct 576. The inlet duct 576 may be positioned above the tub 520. The inlet duct 576 may communicate with an exhaust flow path P formed in a rear side of the tub 520. Air passed through the exhaust flow path P may flow into the dryer 570 through the inlet duct 576.

In the inlet duct 576, a filter 581 for filtering foreign materials such as lint contained in air received from the tub 520 through the exhaust flow path P may be provided. Air flowed into the inlet duct 576 may flow into the heating duct 577 via the filter 581.

The supply duct 578 may supply air heated by passing through the condenser 572 into the tub 520. The supply duct 578 may communicate with the heating duct 577 and extend downward to discharge heated air toward an opening of the tub 520. In the supply duct 578, a blow fan 578*a* for causing air to flow into the tub 520 may be provided. That is, the blow fan 578*a* may form a flow of air to supply air to the inside of the drum 530.

The exhaust flow path P may discharge humid air passed through the tub 520. The exhaust flow path P may be provided behind the tub 520. Internal air of the tub 520 may flow into the exhaust flow path P through a tub exhaust port 550 provided at a rear, lower side of the tub 520. Air discharged from the tub 520 may be supplied to the dryer 570 through the exhaust flow path P. The exhaust flow path P may communicate with the inlet duct 76 of the dryer 570. The exhaust flow path P may be formed by the exhaust duct 560.

The supply duct 578 that supplies heated air into the drum 530 may be located as far away as possible from the tub exhaust port 550. The supply duct 578 and the tub exhaust port 550 may be located diagonally.

Figure 19:
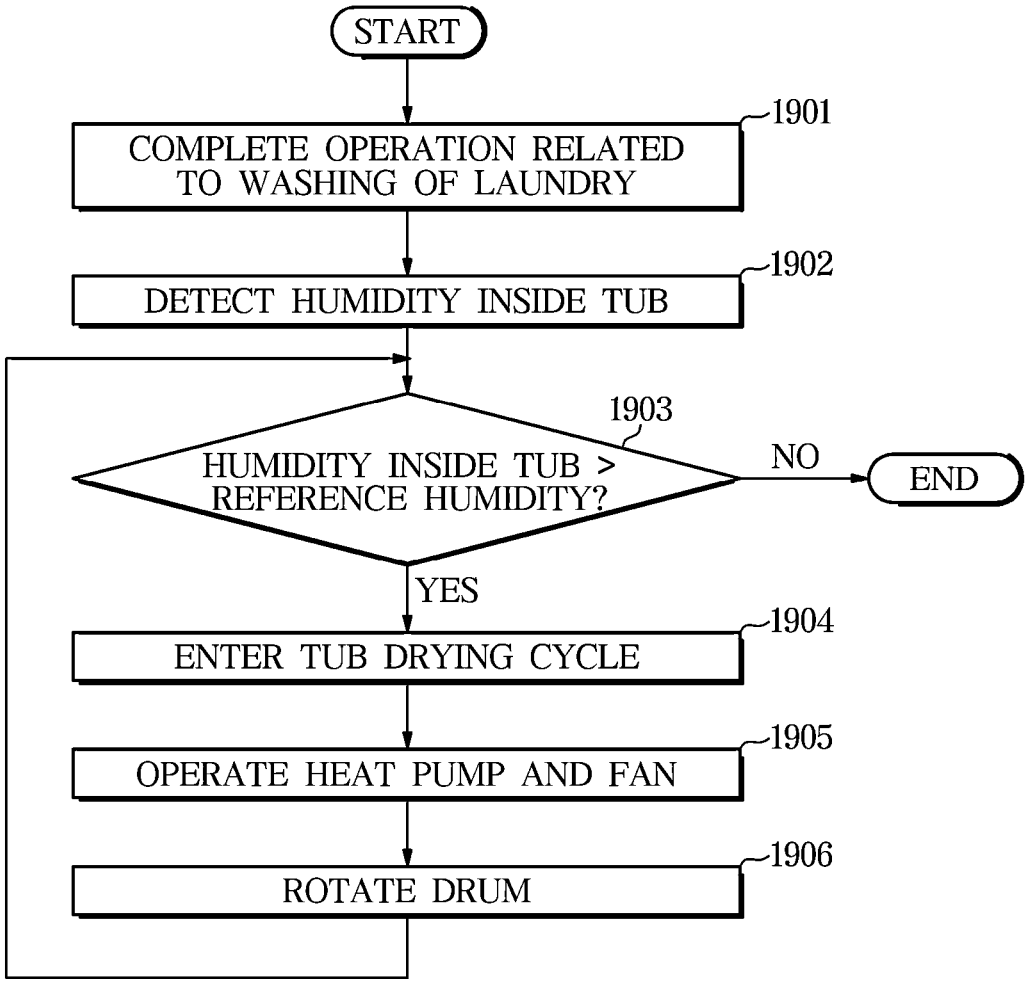
FIG. 19 is a flowchart for describing an embodiment of a method of controlling the clothes treating system shown in FIG. 16.

FIG. 19 is a flowchart for describing an embodiment of a method of controlling the clothes treating system shown in FIG. 16.

Referring to FIG. 19, the clothes treating system 500 may perform an operation (for example, a washing cycle) related to washing of laundry. After the clothes treating system 500 completes the operation related to washing of laundry (1901), the clothes treating system 500 may detect humidity inside the tub 520 (1902). The clothes treating system 500 may compare the detected humidity inside the tub 520 with preset reference humidity (1903). According to the detected humidity inside the tub 520 being higher than or equal to the preset reference humidity, the clothes treating system 500 may enter a tub drying cycle (1904).

According to the detected humidity inside the tub 520 being lower than the preset reference humidity, the clothes treating system 500 may not perform a tub drying cycle. According to humidity inside the tub 520 becoming lower than the preset reference humidity by performing the tub drying cycle, the clothes treating system 500 may terminate the tub drying cycle.

The clothes treating system 500 may operate a heat pump of the dryer 570 and the blow fan 578*a* to perform a tub dry cycle (1905). Also, the clothes treating system 500 may control the driving motor 540 to rotate the drum 530 (1906).

Operating the heat pump of the dryer 570 may include operating the compressor 571 and controlling the expansion valve. While the heat pump of the dryer 570 and the blow fan 578*a* operate, hot air may be generated.

The hot air generated by the heat pump of the dryer 570 and the blow fan 578*a* may flow into the tub 520 and the drum 530 through the heating duct 577 and the supply duct 578. Humid air inside the tub 520 may be discharged to the tub exhaust port 550 and supplied to the dryer 570 along the exhaust flow path P.

According to humidity inside the tub 520 becoming lower than the preset reference humidity by performing the tub drying cycle, the clothes treating system 500 may stop operating the heat pump and the blow fan 578*a*. Also, the clothes treating system 500 may stop rotating the drum 530.

A clothes treating system according to an embodiment may include: a washing machine including a tub and a first drum being rotatable inside the tub; and a dryer including a second drum being rotatable inside a housing, a heat pump, and a fan. The clothes treating system may include: a first duct forming a first flow path for moving hot air generated by the heat pump to the tub; a damper configured to open or close the first duct; a second duct forming a second flow path for moving air inside the tub to the dryer; a humidity sensor configured to detect humidity inside the tub; and a controller electrically connected to the heat pump, the fan, the damper, and the humidity sensor.

The controller may identify whether to perform a tub drying cycle for removing moisture inside the tub and the first drum, based on humidity inside the tub, the humidity detected by the humidity sensor. The controller may open the damper and operate the heat pump and the fan, based on identifying that the tub drying cycle needs to be performed, such that hot air generated by the heat pump flows into the tub through the first duct and moisture inside the tub flows into the housing of the dryer through the second duct.

The first duct may include: one end penetrating a rear, lower side of the housing of the dryer; and another end connected to an upper, front side of the tub of the washing machine, and the second duct may include: one end connected to a lower, rear side of the tub of the washing machine; and another end penetrating a rear, upper side of the housing of the dryer.

The damper may be a first damper, and the dryer may include: a guide duct guiding hot air generated by the heat pump to the second drum; and a second damper configured to open or close the guide duct. The controller may close the second damper to prevent the hot air from being supplied to the second drum, based on identifying that the tub drying cycle needs to be performed.

The first duct may include: one end penetrating a rear, lower side of the housing of the dryer; and another end connected to an upper, front side of the tub of the washing machine, and the second duct may include: one end connected to a lower, rear side of the tub of the washing machine; and another end connected to a filter duct positioned in front of the second drum.

The damper may be a first damper, and the dryer may include: a guide duct guiding hot air generated by the heat pump to the second drum; a second damper configured to open or close the guide duct; and a third damper configured to open or close the filter duct. The controller may close, based on identifying that the tub drying cycle needs to be performed, the second damper to prevent the hot air from being supplied to the second drum and close the third damper to prevent the moisture from flowing into the second drum.

The washing machine may include a first drum motor configured to rotate the first drum. The dryer may include a second drum motor configured to rotate the second drum. The controller may control, in the tub drying cycle, the first drum motor to rotate the first drum of the washing machine and control the second drum motor to stop rotating the second drum of the dryer.

The controller may identify whether to perform the tub drying cycle after an operation of the washing machine related to washing of laundry accommodated in the first drum is completed.

The controller may control the humidity sensor to detect humidity inside the tub while a door of the washing machine is closed.

The controller may stop operating the heat pump and the fan based on humidity inside the tub becoming lower than preset reference humidity while the tub drying operation is performed.

The clothes treating system may further include a user interface configured to obtain a user input. The controller may identify whether to perform the tub drying cycle based on a selection of a tub drying course according to the user input and humidity inside the tub.

The washing machine may include a door and a door driving device configured to open or close the door. The controller may control the door driving device to open the door based on completion of the tub drying cycle.

A method of controlling a clothes treating system, according to an embodiment, the clothes treating system including a washing machine including a tub and a first drum, a dryer including a housing, a second drum, a heat pump, and a fan, a first duct connecting the housing of the dryer to the tub of the washing machine, and a second duct connecting the housing of the dryer to the tub of the washing machine, may include: detecting humidity inside the tub by a humidity sensor; identifying, by a controller, whether to perform a tub drying cycle for removing moisture inside the tub and the first drum based on humidity inside the tub; and opening, by the controller, based on identifying that the tub drying cycle needs to be performed, a damper provided in the first duct and operating the heat pump and the fan, such that hot air generated by the heat pump flows into the tub through the first duct and moisture inside the tub flows into the housing of the dryer through the second duct.

The damper may be a first damper, and the dryer may include a guide duct guiding hot air generated by the heat pump to the second drum. The method may further include closing, by the controller, based on identifying that the tub drying cycle needs to be performed, the second damper provided in the guide duct to prevent the hot air from being supplied to the second drum.

The damper may be a first damper, and the dryer may include a guide duct guiding hot air generated by the heat pump to the second drum, and a filter duct positioned in front of the second drum. The method may further include closing, by the controller, based on identifying that the tub drying cycle needs to be performed, a second damper provided in the guide duct to prevent the hot air from being supplied to the second drum and closing a third damper provided in the filter duct to prevent the moisture from flowing into the second drum.

The method may further include rotating, by the controller, the first drum of the washing machine and stopping rotating the second drum of the dryer in the tub drying cycle.

Whether to perform the tub drying cycle may be identified based on humidity inside the tub, detected after an operation of the washing machine related to washing of laundry accommodated inside the first drum is completed.

The humidity inside the tub may be detected while the door of the washing machine is closed.

Operations of the heat pump and the fan may stop based on the humidity inside the tub becoming preset reference humidity while the tub drying cycle is performed.

The method may further include obtaining a user input of selecting a tub drying course through a user interface. Whether to perform the tub drying cycle may be identified based on a selection of the tub drying course and humidity inside the tub.

The method may further include controlling a door driving device to open the door of the washing machine based on completion of the tub drying cycle.

The clothes treating system 1 and the control method thereof may provide a duct structure for effectively removing water vapor and/or moisture remaining inside the tub 20 and the first drum 30 of the washing machine 10.

The clothes treating system 1 and the control method thereof may suppress the growth of mold and bacteria in the tub 20 and the first drum 30 and keep the tub 20 and the first drum 30 clean by performing a tub drying cycle.

Also, the clothes treating system 1 and the control method thereof may suppress the growth of mold and bacteria in an indoor space by preventing a large amount of water vapor in the tub 20 from being discharged into the indoor space immediately after completing a laundry-washing related operation of the washing machine 10.

Meanwhile, the disclosed embodiments may be implemented in the form of a recording medium that stores instructions executable by a computer. The instructions may be stored in the form of program codes, and when executed by a processor, the instructions may generate a program module to perform the operations of the disclosed embodiments.

The machine-readable storage medium may be provided in the form of a non-transitory storage medium, wherein the term 'non-transitory storage medium' simply means that the storage medium is a tangible device, and does not include a signal (e.g., an electromagnetic wave), but this term does not differentiate between where data is semi-permanently stored in the storage medium and where the data is temporarily stored in the storage medium. For example, the 'non-transitory storage medium' may include a buffer in which data is temporarily stored.

The method according to various embodiments may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloadable or uploadable) online via an application store (e.g., Play Store™) or between two user devices (e.g., smart phones) directly. When distributed online, at least part of the computer program product (e.g., a downloadable app) may be temporarily generated or at least temporarily stored in the machine-readable storage medium, such as a memory of the manufacturer's server, a server of the application store, or a relay server.

So far, the disclosed embodiments have been described with reference to the accompanying drawings. It will be apparent that those skilled in the art can make various modifications thereto without changing the technical spirit and essential features of the disclosure. Thus, it should be understood that the embodiments described above are merely for illustrative purposes and not for limitation purposes in all aspects.

The invention claimed is:

1. A clothes treating system comprising:

a washing machine including a tub;

a dryer including a heat pump and a fan;

a first duct to form a first flow path to move air heated by the heat pump to the tub;

a damper configured to open and close the first flow path;

a second duct to form a second flow path to move moisture from the tub to the dryer;

a humidity sensor to detect humidity inside the tub; and a controller configured to:

determine whether to perform a tub drying cycle to remove the moisture from the tub, based on the detected humidity, and based on determining to perform the tub drying cycle, open the first flow path with the damper, operate the heat pump to heat air, and operate the fan to move the heated air through the first flow path, so that the heated air flows into the tub through the first flow path and the moisture from inside the tub is absorbed by the heated air and flows with the heated air into the dryer through the second flow path.

2. The clothes treating system of claim 1, wherein the first duct includes:

a first duct first end penetrating a lower rear side of a housing of the dryer; and a first duct second end connected to an upper front side of the tub, and the second duct includes:

a second duct first end connected to a lower side of the tub; and a second duct second end penetrating a rear upper side of the housing.

3. The clothes treating system of claim 2, wherein the damper is a first damper, the dryer further includes:

a drum of the dryer, a guide duct to guide the air heated by the heat pump to the drum of the dryer, and a second damper configured to open and close the guide duct, and the controller is further configured to:

based on determining to perform the tub drying cycle, close the second damper to prevent the heated air from being supplied to the drum of the dryer through the guide duct.

4. The clothes treating system of claim 1, wherein the dryer further includes a drum of the dryer, the first duct includes:

a first duct first end penetrating a lower rear side of a housing of the dryer, and a first duct second end connected to an upper front side of the tub, and the second duct includes:

a second duct first end connected to a lower rear side of the tub, and a second duct second end connected to a filter duct which is positioned in front of the drum of the dryer.

5. The clothes treating system of claim 4, wherein the damper is a first damper, the dryer further includes:

a guide duct to guide the air heated by the heat pump to the drum of the dryer;

a second damper configured to open and close the guide duct; and a third damper configured to open and close the filter duct, and the controller is further configured to:

based on determining to perform the tub drying cycle, close the second damper to prevent the heated air from being supplied to the drum of the dryer through the guide duct and close the third damper to prevent the moisture absorbed by the heated air from flowing through the filter duct into the drum of the dryer.

6. The clothes treating system of claim 1, wherein the washing machine further includes:

a first drum and a first drum motor configured to rotate the first drum, the dryer further includes:

a second drum and a second drum motor configured to rotate the second drum, and the controller is further configured to:

in the tub drying cycle, control the first drum motor to rotate the first drum of the washing machine and control the second drum motor to stop rotation of the drum of the dryer.

7. The clothes treating system of claim 1, wherein the washing machine further includes a drum of the washing machine, and the controller is further configured to determine whether to perform the tub drying cycle after an operation of the washing machine related to washing of laundry accommodated in the drum of the washing machine is completed.

8. The clothes treating system of claim 1, wherein the controller is further configured to control the humidity sensor to detect humidity inside the tub while a door of the washing machine is closed.

9. The clothes treating system of claim 1, wherein the controller is further configured to stop operation of the heat pump and operation of the fan based on the detected humidity becoming lower than a preset reference humidity while the tub drying cycle is performed.

10. The clothes treating system of claim 1, further comprising:

a user interface configured to obtain a user input, wherein the controller is further configured to determine whether to perform the tub drying cycle based on a selection of a tub drying course according to the user input and the detected humidity.

11. The clothes treating system of claim 1, wherein the washing machine further includes:

a door, and a door driving device configured to open and close the door, and the controller is further configured to control the door driving device to open the door based on completion of the tub drying cycle.

12. A method of controlling a clothes treating system having a washing machine including a tub, a dryer including a heat pump, and a fan, a first duct to form a first flow path to move air heated by the heat pump to the tub, a damper configured to open and close the first flow path, a second duct to form a second flow path to move moisture from the tub to the dryer, a humidity sensor to detect humidity inside the tub, and a controller, the method comprising:

detecting humidity inside the tub with the humidity sensor;

determining, by the controller, whether to perform a tub drying cycle to remove the moisture from the tub based on the detected humidity; and by the controller, based on determining to perform the tub drying cycle, opening the first flow path with the damper, operating the heat pump to heat air, and operating the fan to move the heated air through the first flow path, so that the heated air flows into the tub through the first flow path and the moisture from inside the tub is absorbed by the heated air and flows with the heated air into the dryer through the second flow path.

13. The method of claim 12, wherein the damper is a first damper, and the dryer further includes:

a drum of the dryer, a guide duct to guide the air heated by the heat pump to the drum of the dryer, and a second damper configured to open and close the guide duct, and the method further includes: by the controller, based on determining to perform the tub drying cycle, closing the second damper to prevent the heated air from being supplied to the drum of the dryer through the guide duct.

14. The method of claim 12, wherein the damper is a first damper, and the dryer further includes:

a drum of the dryer, a guide duct to guide the air heated by the heat pump to the drum of the dryer, a second damper configured to open and close the guide duct, a filter duct positioned in front of the drum of the dryer, and a third damper configured to open and close the filter duct, and the method further includes by the controller, based on determining to perform the tub drying cycle, closing the second damper to prevent the heated air from being supplied to the drum of the dryer through the guide duct and closing the third damper to prevent the moisture absorbed by the heated air from flowing through the filter duct into the drum of the dryer.

15. The method of claim 12, wherein the washing machine further includes:

a first drum, and a first drum motor configured to rotate the first drum, the dryer further includes:

a second drum, and a second drum motor configured to rotate the second drum, and the method further includes: by the controller, in the tub drying cycle, controlling the first drum motor to rotate the first drum of the washing machine and controlling the second drum motor to stop rotation of the second drum of the dryer.

* * * * *